US006446634B2

(12) United States Patent
Fukuyama

(10) Patent No.: US 6,446,634 B2
(45) Date of Patent: Sep. 10, 2002

(54) AUTOMATED WIG MANUFACTURING SYSTEM

(75) Inventor: Kohki Fukuyama, Tokyo (JP)

(73) Assignee: Hiroshi Hochi, Tokyo (JP)

( * ) Notice: Subject to any disclaimer, the term of this patent is extended or adjusted under 35 U.S.C. 154(b) by 0 days.

(21) Appl. No.: 09/832,570

(22) Filed: Apr. 11, 2001

(30) Foreign Application Priority Data

Apr. 28, 2000 (JP) ..... 2000-129955
Apr. 28, 2000 (JP) ..... 2000-129956

(51) Int. Cl.[7] ..... A41G 3/00; A41G 5/00

(52) U.S. Cl. ..... 132/53; 132/201; 132/200; 132/56

(58) Field of Search ..... 132/53, 201, 200, 132/56, 54

(56) References Cited

U.S. PATENT DOCUMENTS 1,199,144 A * 9/1916 Zak ..... 132/201
3,013,567 A * 12/1961 Sotzky ..... 132/201
3,467,110 A * 9/1969 Frishman ..... 132/201
4,784,713 A * 11/1988 Van Nieulande ..... 132/53
5,921,253 A * 7/1999 Jeong ..... 132/201

* cited by examiner

*Primary Examiner*—John J. Wilson
*Assistant Examiner*—Robyn Kieu Doan
(74) *Attorney, Agent, or Firm*—Frishauf, Holtz, Goodman & Chick, P.C.

(57) ABSTRACT

Disclosed is an automated wig manufacturing system. A two-dimensional thin wig base (11) of fabric material woven by resin fiber, for example, is supplied to above a conveyor table (21), whereas an artificial hair (30) is supplied to the underside of the base. The base is subjected to tensioning rollers (23) so that it is placed on the table in a stretched condition. A reciprocating needle (41) penetrates the stretched base to engage the artificial hair, which is pulled above to thereby transplanted on the base. The hair transplanting operation in such a manner is repeated at different points, as the table is moved in predetermined direction(s) with a predetermined pitch. After the hair transplanting operation is completed, the base is released from being stretched, thereby allowing shrinkage of the base due to its material shrinkability. The base with the artificial hairs transplanted is then formed into a three-dimensional configuration to provide fittability to a human head.

19 Claims, 30 Drawing Sheets

AUTOMATED WIG MANUFACTURING SYSTEM

BACKGROUND OF THE INVENTION

1. Field of the Invention

The present invention relates to an automated wig manufacturing system.

2. Description of the Prior Art

A wig has been manufactured in such a manner that a hair segment is folded in two, which is one by one transplanted onto a three-dimensional thick base by handwork. When one folded hair segment is transplanted on the base, it looks as if two hairs are transplanted. To manufacture a wig with 20,000 hairs transplanted, for example, such laborious task must be repeated 10,000 times. This increases a manufacturing cost of the wig. Some attempts have been made to develop automated wig manufacturing systems, but produced no practical success.

SUMMARY OF THE INVENTION

Accordingly, it is a principal object of the present invention to overcome the drawbacks and disadvantages of the prior art wig manufacturing system.

Another object of the present invention is to provide an novel automated and machinized wig manufacturing system capable of manufacturing wigs at a drastically reduced cost when compared with the prior art handmade wigs.

In accordance with an aspect of the present invention, therefore, there is provided an automated wig manufacturing apparatus comprising: a conveyor table; table drive means for moving said table on a two-dimensional plane at a predetermined pitch; base supply means for supplying a two-dimensional thin base to said table; tensioning and positioning means for stretching said base and positioning said stretched base at predetermined position with respect to said table; artificial hair supply means for supplying an artificial hair to the underside of said stretched base; hair transplanting means for transplanting said artificial hair on said base, said hair transplanting means including needle means reciprocating in first and second directions both perpendicular to said base, said needle means being moved in said first direction to penetrate said base and in said second direction, opposite to said first direction, to engage said artificial air at the underside of said base so that said artificial hair carried by said needle means is transplanted on said base, hair transplanting operation by said hair transplanting means being repeated as said table is moved by said drive means to an adjacent position remote from a preceding position by said predetermined pitch. The tensioning and positioning means is made inoperative after said hair transplanting operation by said hair transplanting means is completed, thereby releasing said base from being stretched by said tensioning and positioning means to allow shrinkage of said base due to material shrinkability thereof.

In a preferable embodiment, the apparatus further comprises: first adhesive applying means for applying first adhesive to the underside of said base for adhering said transplanted artificial hair to said base; cutting means for cutting said base, to which said first adhesive has been applied by said first adhesive applying means, into a base piece of a predetermined size; forming means for forming said base piece into a predetermined three-dimensional configuration: and second adhesive applying means for applying second adhesive to the underside of said three-dimensional base.

The base is preferably woven fabric.

The needle means preferably has a needle groove extending perpendicular to a direction of supply of said artificial hair by said artificial hair supply means, said needle groove being adapted to engage said artificial hair when said needle means is moved in said second direction.

The needle means may comprise at least one pair of needles reciprocating in synchronism with each other, said needles being spaced by a predetermined distance in parallel with the direction of supply of said artificial hair by said artificial hair supply means.

The pitch of movement of said table, which is a hair transplanting pitch in the hair transplanting operation by said hair transplanting means, is preferably greater than width of said needle means perpendicular to the direction of supply of said artificial hair by said artificial hair supply means.

The table may be moved intermittently by said table drive means in a direction perpendicular to the direction of supply of said artificial hair by said artificial hair supply means, during the hair transplanting operation by said hair transplanting means. The table may also be moved intermittently by said table drive means in parallel with the direction of supply of said artificial hair by said artificial hair supply means, during the hair transplanting operation by said hair transplanting means. Alternatively, the hair transplanting means transplants said artificial hair on said base in a direction oblique to a direction of movement of said table by said table drive means.

Movement of said table and said needle means may be controlled by a computer.

The artificial hair supply means may comprise a plurality of artificial hair supplying units, each supplying an artificial hair of a different color.

Preferably, the apparatus further includes hair separating means for disengaging said artificial hair from said needle means, after said artificial hair has been transplanted on said base by said hair transplanting means. The hair separating means may comprise at least one of means for blowing an air flow to said transplanted artificial hair, means for absorbing said transplanted artificial hair by vacuum suction, and a static electricity generator for absorbing said transplanted artificial hair by static electricity.

The artificial hair supply means may comprise a plurality of bobbins each carrying a continuous artificial hair of a different color, a plurality of first vacuum generators each being mounted adjacent to one of said bobbins to unreel said artificial hair therefrom, cutter means for cutting said unreeled artificial hair to a predetermined length, and a single second vacuum generator for conveying a mixture of said cut segments of said artificial hairs of different colors to the underside of said stretched base.

In preferable arrangement of the apparatus, the first adhesive applying means, said cutting means, said forming means and said second adhesive applying means are arranged in series in alignment with conveyance of said base.

In accordance with another aspect of the present invention, there is provided an automated wig manufacturing process comprising the steps of supplying a two-dimensional thin base to a conveyor table; stretching said base on said conveyor table; positioning said stretched base with respect to said conveyor table; supplying an artificial hair to the underside of said stretched base; engaging said supplied artificial hair by reciprocating needle means which penetrates said stretched base, said needle means with said artificial hair being moved to above said base so that said artificial hair is transplanted on said stretched base; repeating hair transplanting operation by said needle means while moving said conveyor table at a predetermined pitch; and releasing said base from being stretched, after the hair transplanting operation by said needle means is completed.

The process preferably further comprises the steps of applying first adhesive to the underside of said base for adhering said transplanted artificial hair to said base; cutting said base, to which said first adhesive has been applied by said first adhesive applying means, into a base piece of a predetermined size; forming said base piece into a predetermined three-dimensional configuration: and applying second adhesive to the underside of said three-dimensional base.

BRIEF DESCRIPTION OF THE DRAWINGS

Other objects and advantages of the present invention can be understood from the following description when read in conjunction with the accompanying drawings in which.

DETAILED DESCRIPTION OF THE PREFERRED EMBODIMENT

Figure 1:
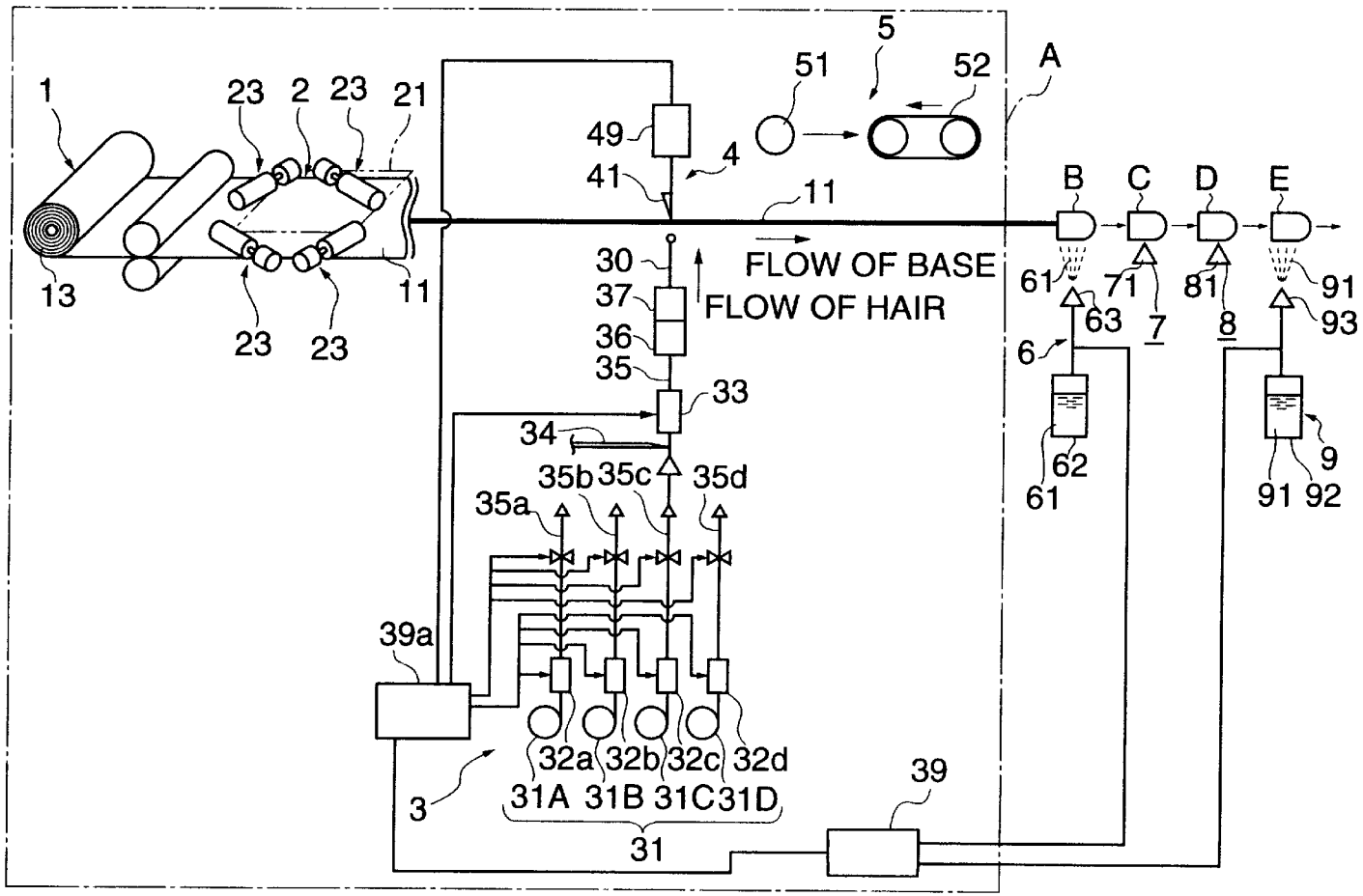
FIG. 1 is an explanatory view showing diagrammatic construction of an automated wig manufacturing apparatus.

An automated wig manufacturing apparatus embodying the present invention will be described in more detail in reference to the accompanying drawings. Elements or parts having the same function are indicated by the same reference numerals throughout the drawings and explanation thereof will not be repeated.

Figure 2:
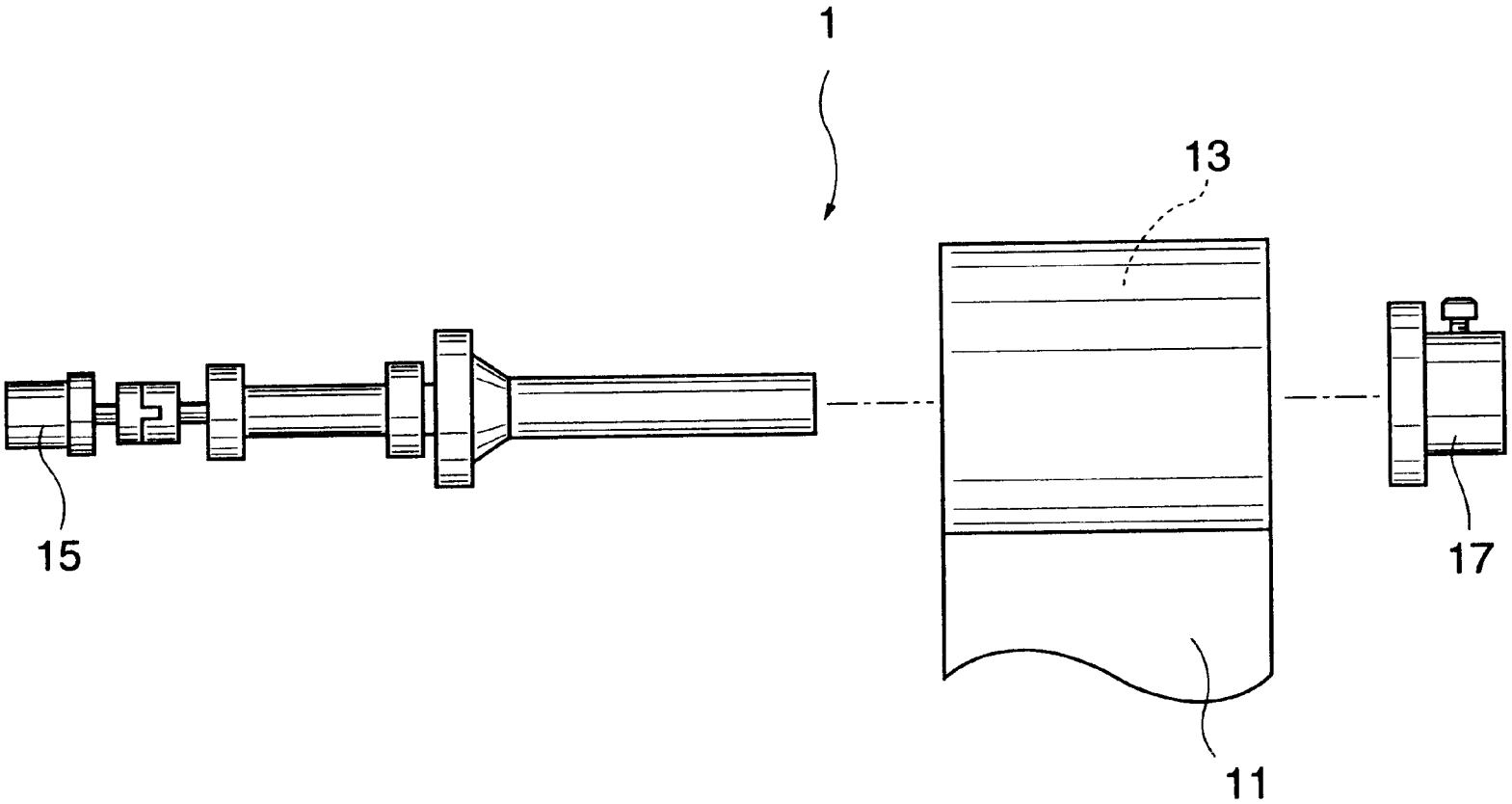
FIG. 2 is a front view showing an example of a base supply station of the wig manufacturing apparatus.

FIG. 1 is an explanatory view showing diagrammatic construction of an automated wig manufacturing apparatus. As shown also in FIG. 2, a thin base 11 is transferred from a base supply station 1 to a tensioning/positioning station 2. The base 11 is a cloth woven by polyurethane fiber, for example, of a thickness of 0.06mm, for example. The base 11 is wounded around a sheet roll 13. The sheet roll 13 is driven by a motor 15 to supply the base 11 therefrom onto a conveyor table 21. A reference numeral 17 indicates a stopper for preventing removal of the sheet roll 13.

Figure 3A:
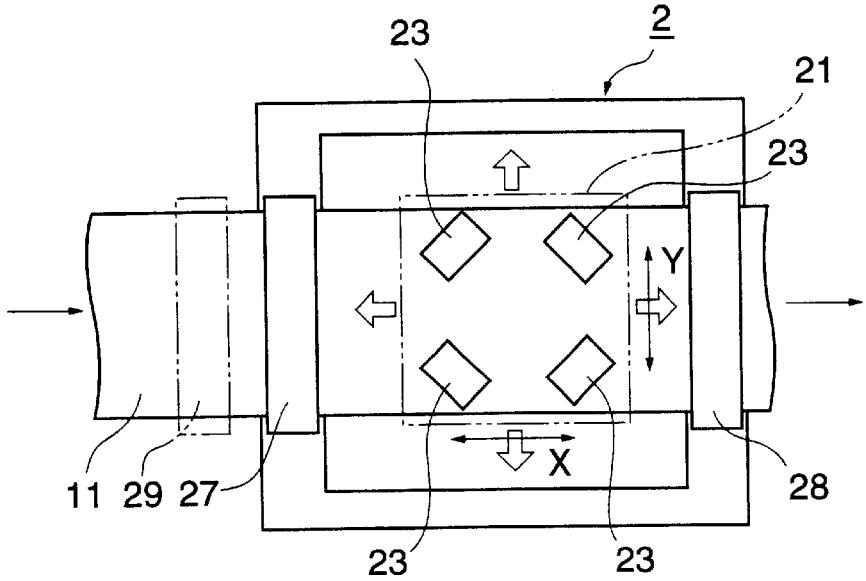
FIG. 3(A) is a plan view showing an example of a tensioning/positioning station of the wig manufacturing apparatus.
Figure 3B:
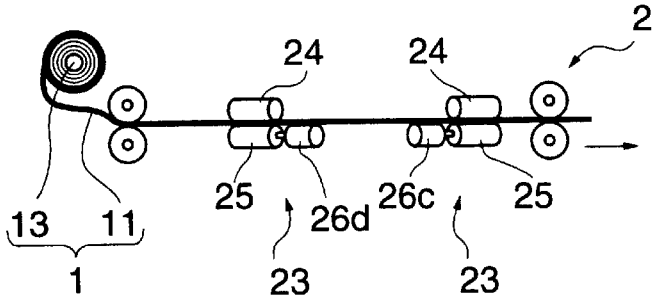
FIG. 3(B) is a front view thereof and FIG. 3(C) is a plan view showing a main part thereof.

FIG. 3 shows the tensioning/positioning station 2 of the hair-transplant unit. The station 2 has the conveyor table 21 movable on a two-dimensional plane along X and Y axes perpendicular to each other. The table 21 is moved along X or Y axis over a predetermined pitch (of 2mm, for example). Such movement is repeated under control in the predetermined order. There are tension rollers 23 at four corners on the conveyor table 21 for tensioning and stretching the supplied base 11. Each tension roller 23 comprises a pair of opposed tension nip rollers 24, 25 and a tension motor 26 (26*a*, 26*b*, 26*c*, 26*d*) for reversibly driving the nip roller 24, 25. A reference numeral 27 indicates a pair of opposed feeder rollers (of which only an upper one is shown in FIG. 3(A)) arranged at the base supply side or inlet of the station 2, which is driven by a motor 27*a* (FIG. 14) to rotate in a predetermined direction for pulling the base 11 onto the table 21. A reference numeral 28 indicates a pair of opposed discharge rollers 28 (of which only an upper one is shown in FIG. 3(A)) arranged at the base discharge side or outlet of the station 2, which is rotatable in opposite directions by a motor 28*a* (FIG. 14). A slack sensor 29 is mounted upstream of the feeder rollers 27 for detecting a slack of the base to be supplied to the tensioning/positioning station 2.

Figure 4:
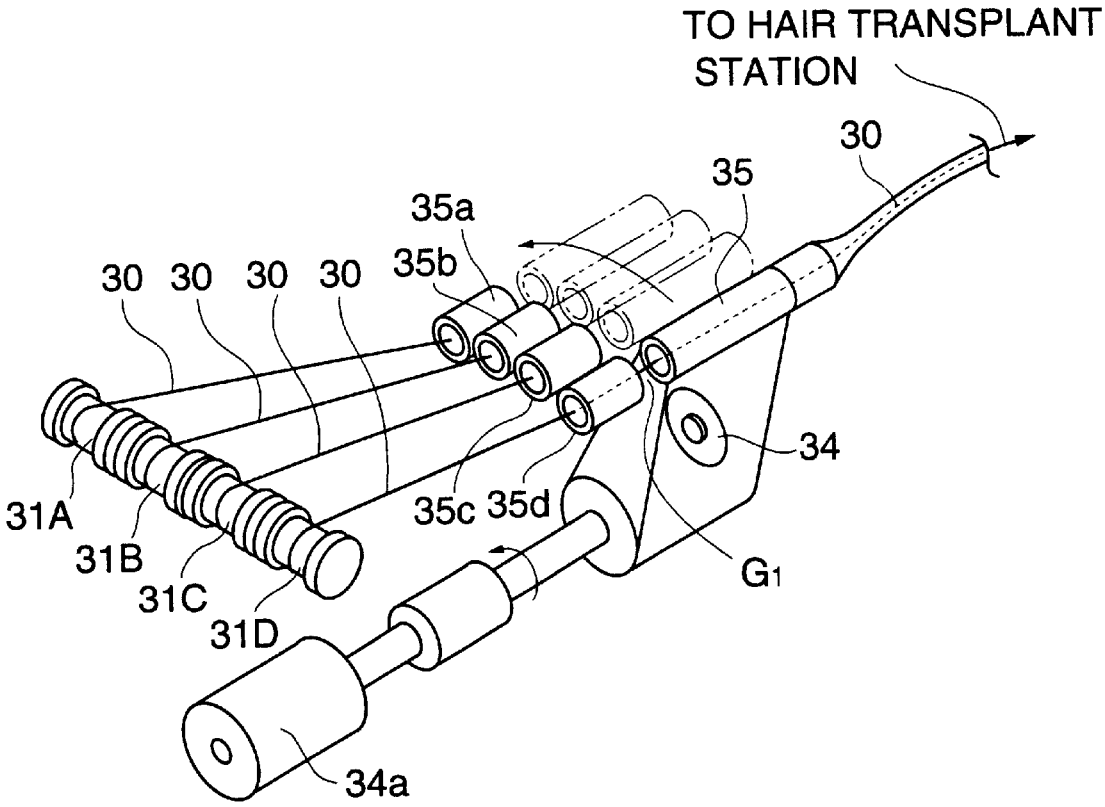
FIG. 4 is a perspective view showing an example of a part of an artificial hair supply station of the apparatus, including a hair cutter and hair supply conduits.
Figure 5A:
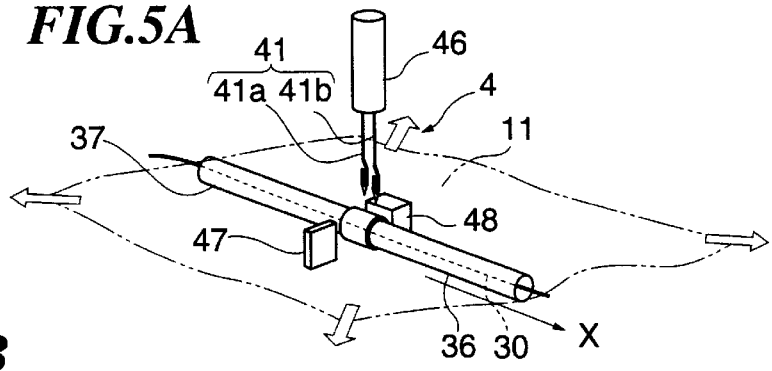
FIG. 5(A) is a perspective view showing an example of a hair transplanting station of the apparatus.
Figure 5B:
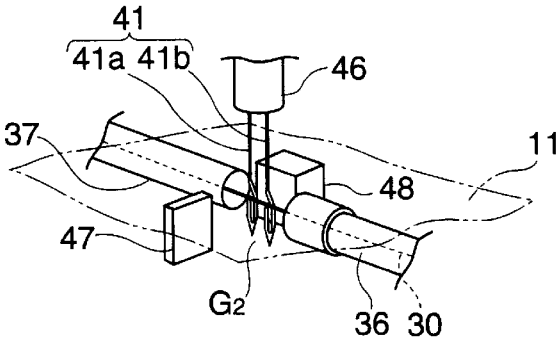
FIGS. 5(B)–(D) are perspective view showing a main part thereof and FIGS. 5(E)–(F) are front views of the main part.
Figure 5C:
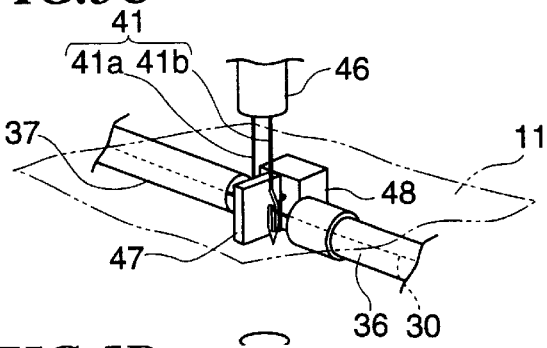
Figure 5D:
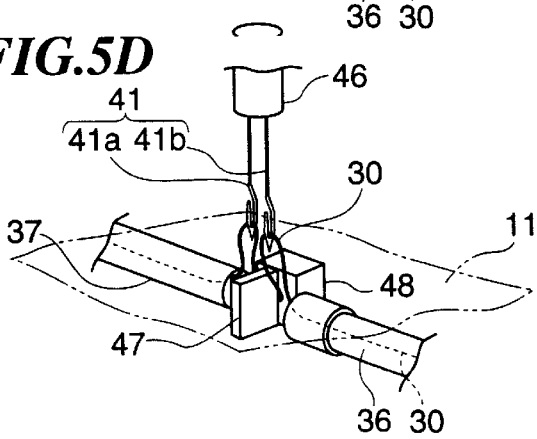
Figure 5E:
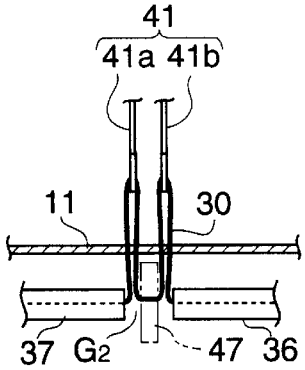
Figure 5F:
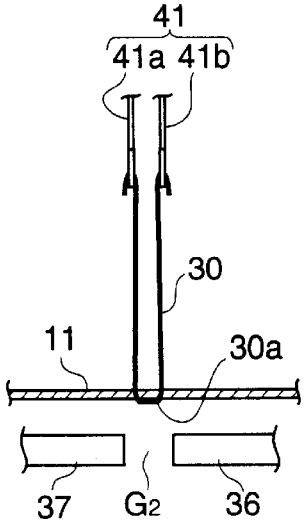

An artificial hair supply station 3 of the hair transplant unit includes bobbins 31A, 31B, 31C and 31D (which may be hereinlater referred to by a generic numeral 31), each carrying a continuous artificial hair 30, and supplies artificial hair 30 to the underside of the base 11. The artificial hair of a different color is reeled around a different bobbin 31. Each bobbin 31 is connected to a separate vacuum generator 32 (32*a*, 32*b*, 32*c*, 32*d*). One of the vacuum generators 32 cooperates with an additional vacuum generator 33 to unreel an artificial hair 30 of a given color from a corresponding one of the bobbins 31. A conduit (35, 35*a*, 35*b*, 35*c*, 35*d*) extends from bobbins 31 for supplying therethrough the artificial hair 30 to a hair transplant station 4. As shown in FIG. 4, there is a swingable hair cutter 34 driven by a motor 34*a* for cutting the artificial hair 30 to a predetermined length during conveyance thereof through one of the conduits 35. For allowing the hair cutter 34 to swing across the respective conveyance path of the artificial hairs 30, each conduit 35 is divided into two sections to provide a gap G1. A phototube sensor 38 (FIG. 10) is mounted at a predetermined position along the conduit 35 to detect the fore end of the artificial hair 30. The artificial hair 30 comprise polyester, acrylic or other plastic fiber. The artificial hair 30 unreeled from the bobbin 31 is conveyed through the conduit 35 which comprises the exclusive conduits 35*a*, 35*b*, 35*c* and 35*d* connected one by one to the bobbins 31A, 31B, 31C and 31D, and a single conduit 35, between which there is the gap G1 for allowing the cutting action of the hair cutter 34. Accordingly, each hairs 30 unreeled from the bobbin 31 is first conveyed through its exclusive conduit (one of the conduits 35*a*–35*d*), then cut by the hair cutter 34 to a predetermined length, and then again conveyed through the common conduit 35 to the hair transplant station 4.

Figure 6A:
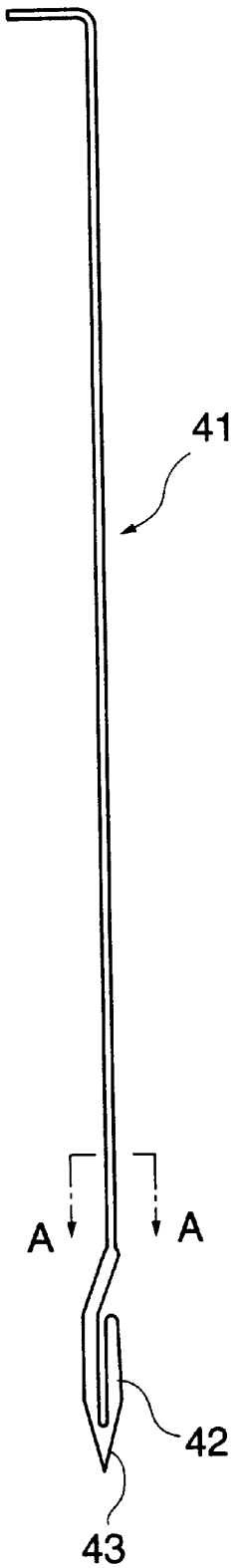
FIG. 6(A) is a front view showing an example of a needle used in the hair transplanting station and FIG. 6(B) is an enlarged front view showing a part of the needle taken along the lines A—A in FIG. 6(A)
Figure 6B:
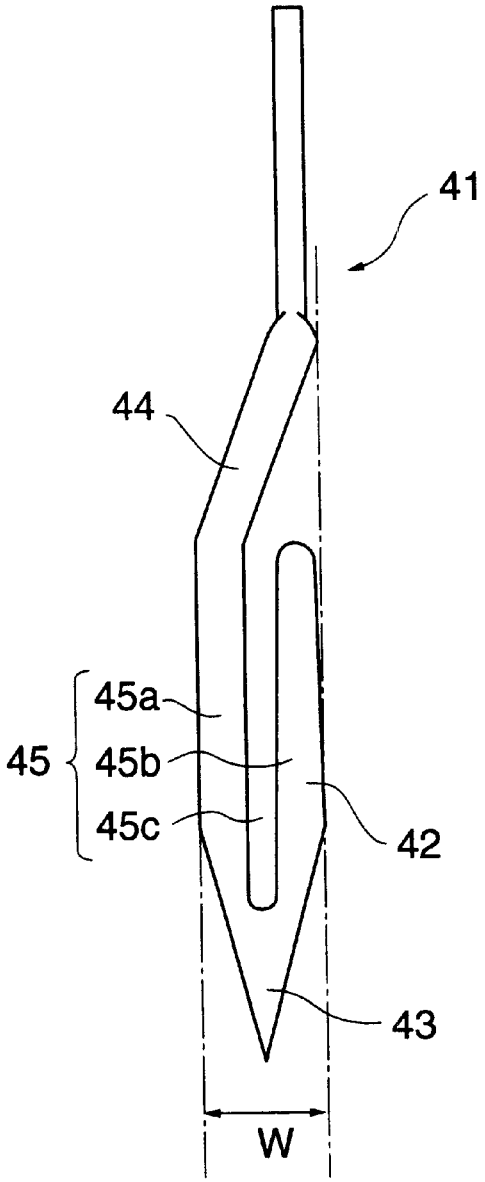
Figure 7A:
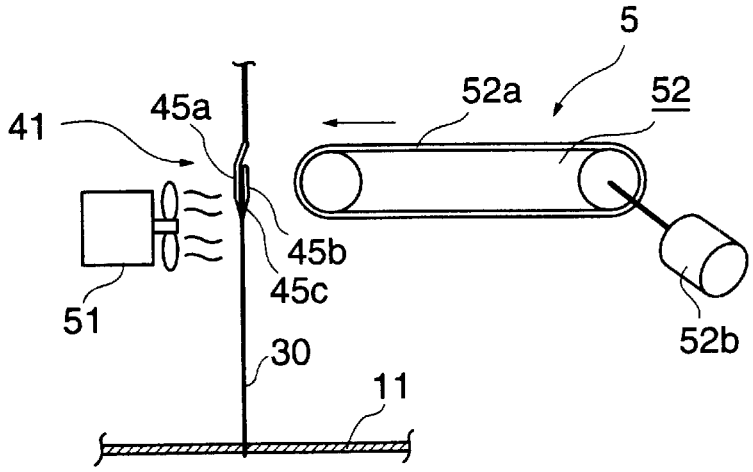
FIGS. 7(A)–(C) are side views showing an example of a hair re-orienting station, said hair reorienting station being shown in a condition where an artificial hair is pulled above by an ascending needle in FIG. 7(A), in a succeeding condition where the artificial hair is unhooked from the needle in FIG. 7(B) and in a still succeeding condition where the artificial hair is laying down onto the base in FIG. 7(C)

The hair transplant station 4 is shown in detail in FIGS. 5–7. The hair transplant station 4 has needles 41 (41*a*, 41*b*) reciprocating in a vertical direction perpendicular to the base 11. The artificial hair 30 is supplied in an arrowed direction in parallel with the X axis. The needle construction is shown in detail in FIG. 6. The needle 41 has an leading end portion 42 with a spearhead 43 and an outwardly spreading base 44. In this embodiment, the leading end portion 42 has a width (W) of 1 mm. The leading end portion 42 of the needle 41 also has a hook 45 including an outer leg 45*a*, an inner leg or tip end 45*b* and a needle groove 45*c* defined therebetween for engagement with the artificial hair 30. The inner surface of the tip end 45*b* is slightly inclined inwardly with respect to the needle axis. As shown specifically in FIG. 5, a vertically reciprocating needle arm 46 carries a pair of needles 41*a*, 41*b* with a predetermined spacing therebetween which may be of the order of 1 mm. The needle grooves 45*c*, 45*c* of the needles 41*a*, 41*b* extend perpendicular to the artificial hair 30 supplied in the X-axis direction. Beneath the needle 41, the common conduit 35 is equipped with a movable guide 36 and a stationary guide 37. The movable guide 36 may be driven by a solenoid (not shown) to move in the X-axis direction, so that it is separable from the stationary guide 37. When the movable guide 36 is moved to separate from the stationary guide 37, there is a gap G2 for allowing the needle 41 to pass therebetween. There is a press block 47 which is movable in a direction perpendicular to the conveyance path of the artificial hair 30 and insertable into the gap G2. When the needles 41*a*, 41*b* fall down into the gap G2, the press block 47 is inserted between these needles 41*a*, 41*b*, so that the supplied artificial hair 30 is engaged between the press block 47 and an opposed stationary block 48.

Figure 7B:
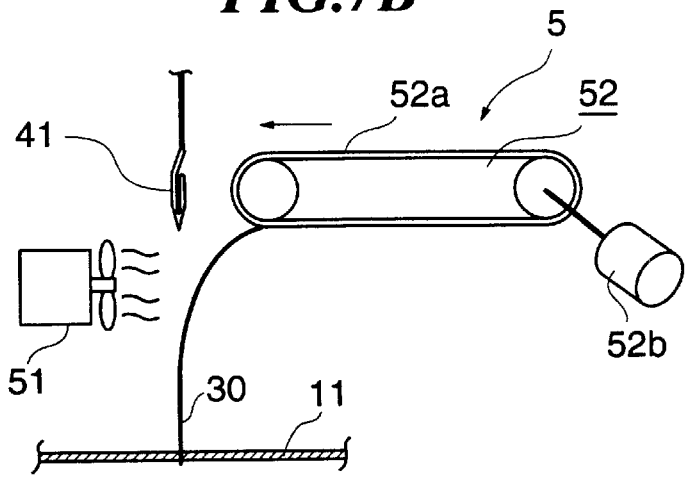
Figure 7C:
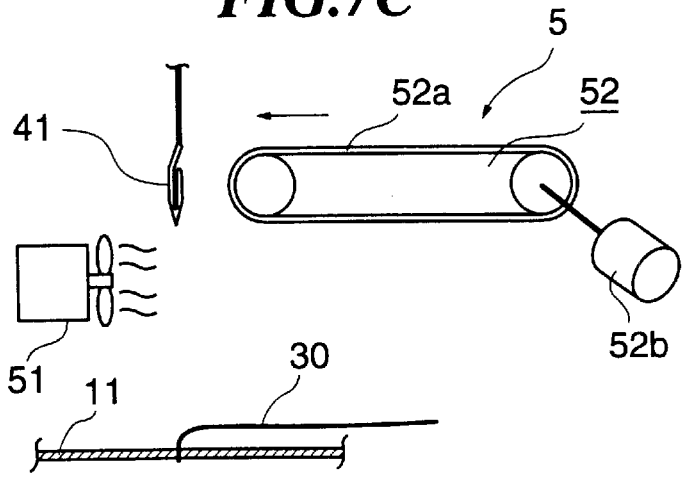
Figure 8A:
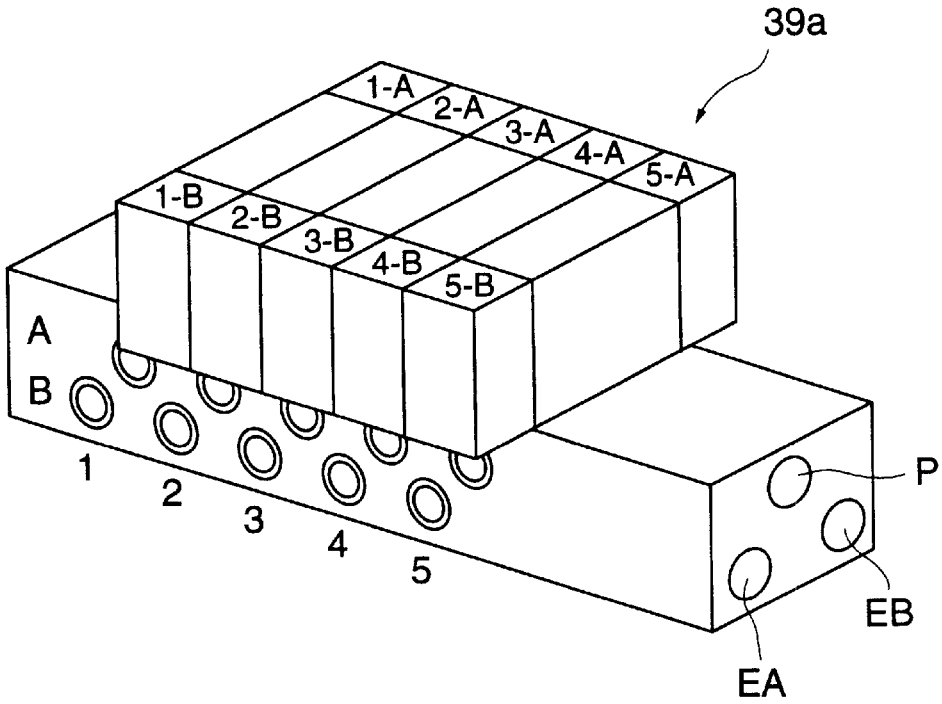
FIG. 8(A) is a perspective view showing an example of an electromagnetic valve used in the wig manufacturing apparatus and FIG. 8(B) shows a circuit thereof.
Figure 8B:
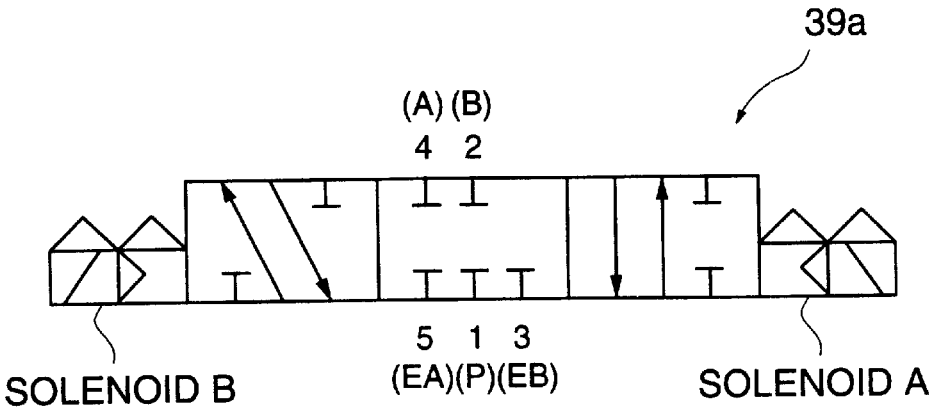
Figure 9A:
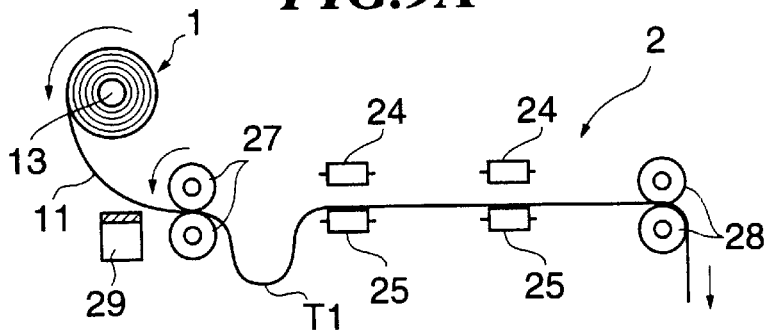
FIGS. 9(A)–(D) are explanatory views for explanation of how to give slacks to the base.
Figure 9B:
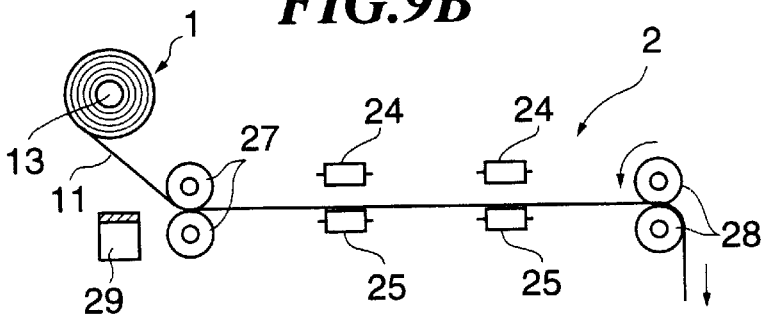
Figure 9C:
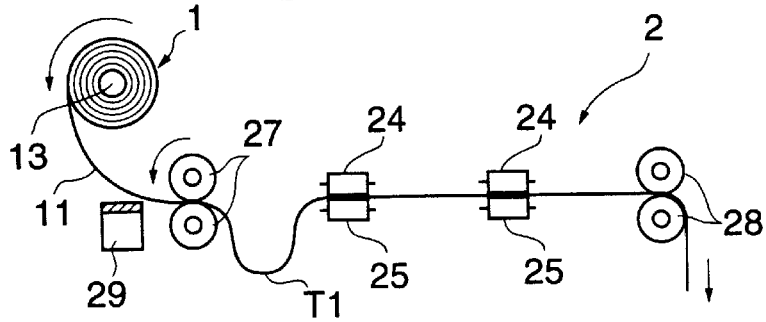
Figure 9D:
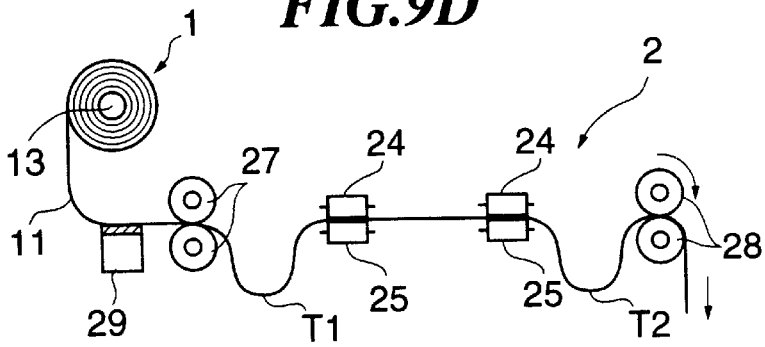
Figure 10A:
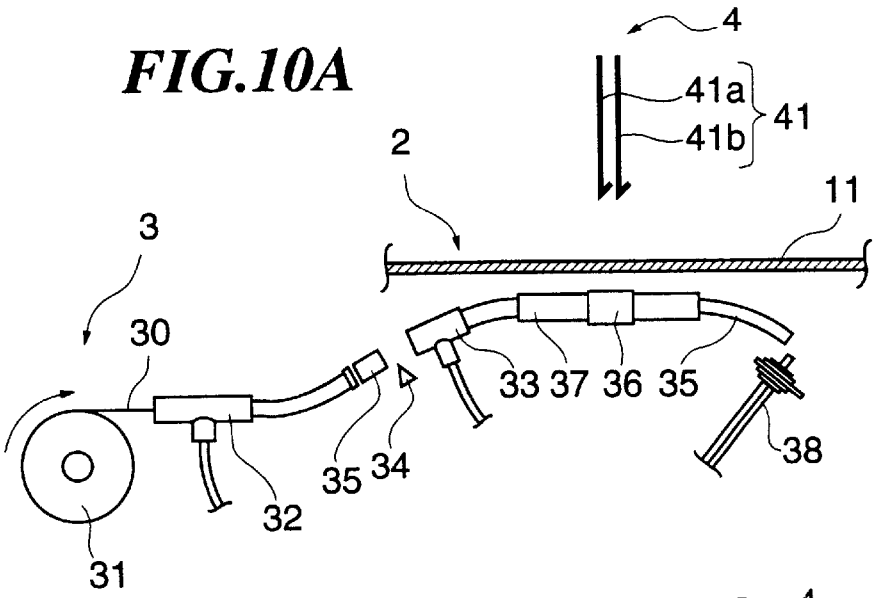
FIGS. 10(A)–(D) are front views showing the manner of feeding the artificial hair to the hair transplanting station.
Figure 10B:
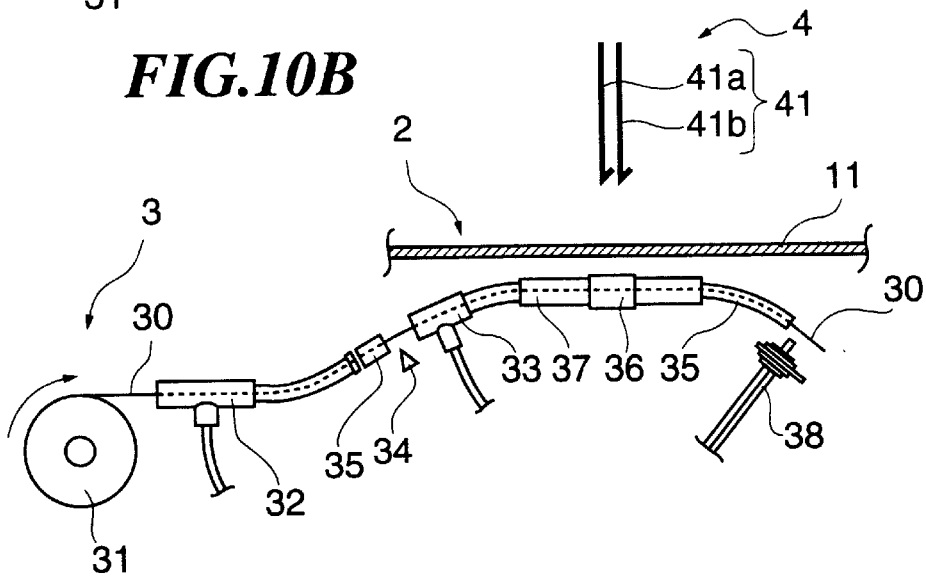
Figure 10C:
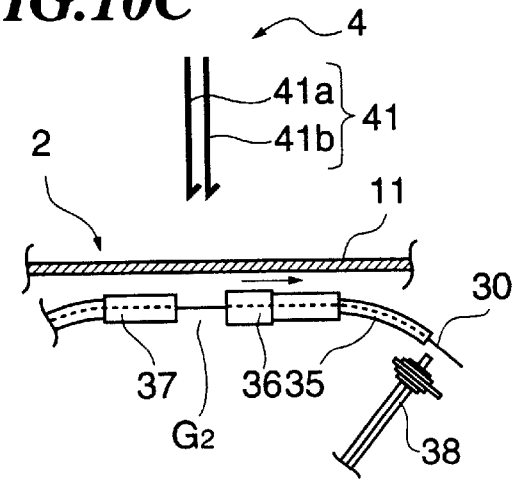
Figure 10D:
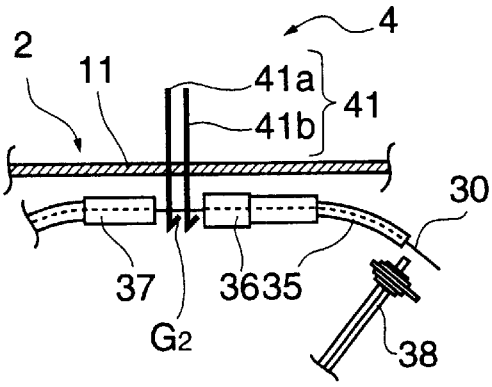
Figure 11A:
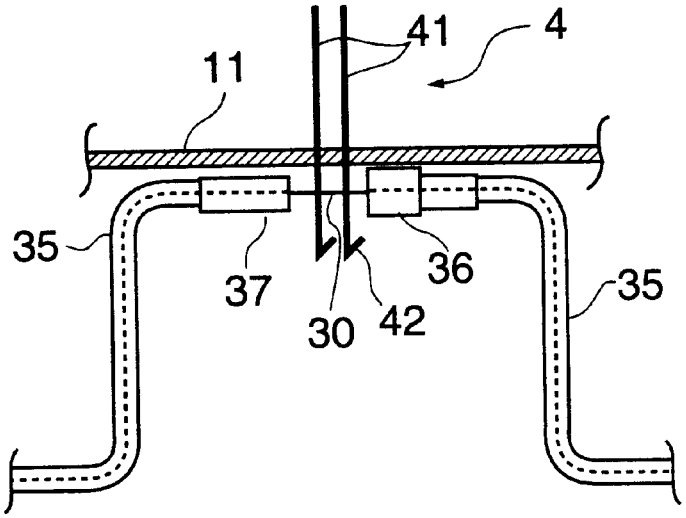
FIGS. 11(A)–(B) are front and left side views of the hair transplanting station where the needle penetrates the base during its descent.
Figure 11B:
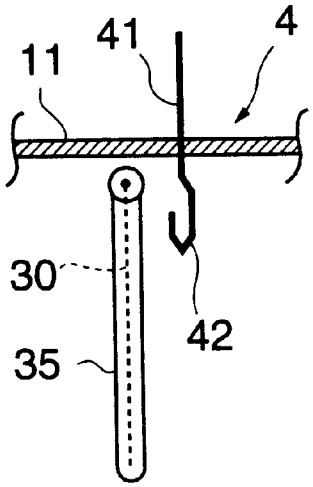
Figure 12A:
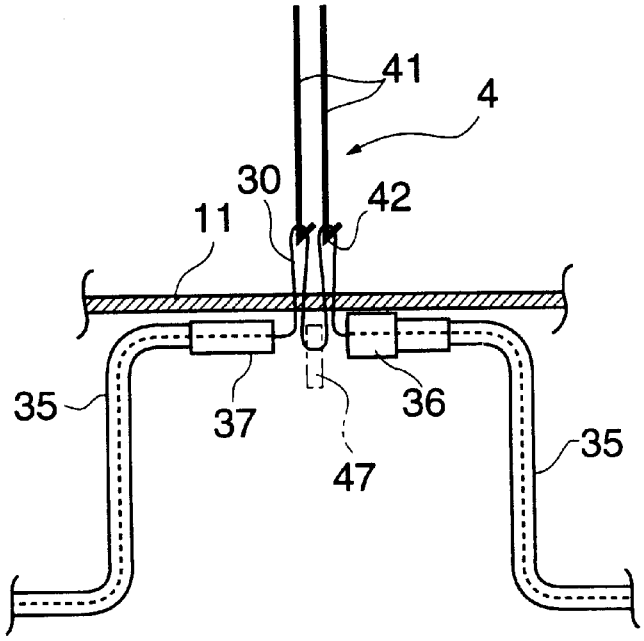
FIGS. 12(A)–(B) are front and left side views of the hair transplanting station where the artificial hair hooked by the needle is pulled upward during ascent of the needle.
Figure 12B:
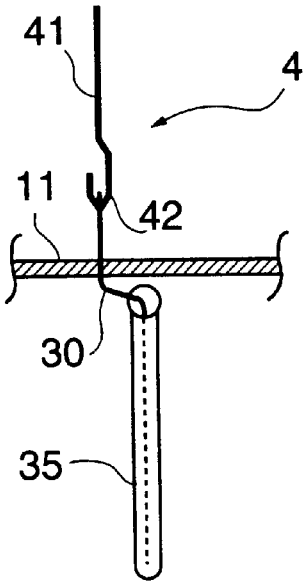
Figure 13:
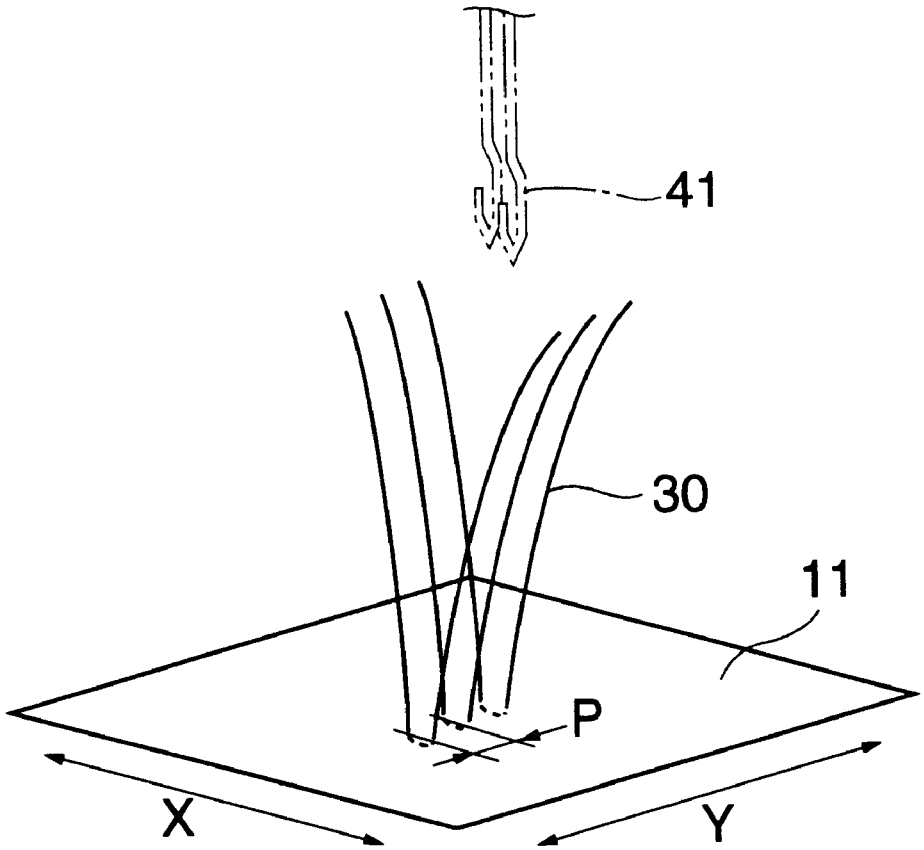
FIG. 13 is a perspective view showing the base on which the artificial hairs have been transplanted with a predetermined pitch.

FIG. 7 shows a hair reorienting station 5 in the hair transplant station 4. This station 5 has a fan 51 and a static electricity generator 52 in opposition to each other across the reciprocating needle 41. The fan 51 supplies an air flow to the needle 41. The static electricity generator 52 comprises an endless nylon belt 52*a* driven by a motor 52*b* to run in an arrowed direction to generate static electricity for absorbing the artificial hair 30, as best seen in FIG. 7(B). Shown in FIG. 8 is an electromagnetic valve (three-position closed center double solenoid) 39*a* which operates in synchronism with an air compressor 39 to activate the vacuum generators 32, 33. The electromagnetic valve 39*a* is also used to drive a hydraulic cylinder 49 for reciprocating the needle 41.

The operation of the hair transplant unit of the automated wig manufacturing apparatus will now be described in reference to FIGS. 9–14. A slack T1 is first given to the base 11 at a point between the feeder rollers 27 and the tension nip rollers 24, 25 (FIG. 9(A)), and the discharge rollers 28 are rotated to feed the base 11 (FIG. 9(B)). Up to this time, the opposed tension nip rollers 24 and 25 separate with each other. Then, the nip rollers 24, 25 are closed so that the base 11 is interposed therebetween, thereby again providing a slack T1 between the feeder rollers 27 and the tension nip rollers 24, 25(FIG. 9(C)). The discharge rollers 28 is then driven to rotate in a reverse direction to provide another slack T2 between the tension nip rollers 24, 25 and the discharge rollers 28 (FIG. 9(D)). The total amounts of the slacks T1 and T2 should be enough to move the table 21 over a predetermined stroke. In FIGS. 9(A)–9(D), the notched area of the sensor 29 indicates an area of detection. The base 11 is transferred from the left to the right.

Figure 3C:
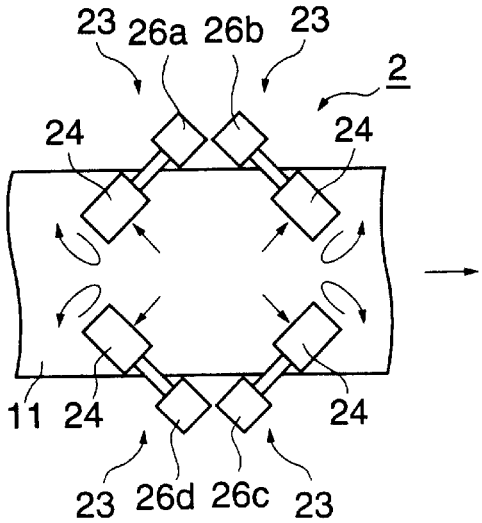

The base 11 is nipped between the tension nip rollers 24, 25 into a stretched, unwrinkled condition over the conveyor table 21, as shown in FIG. 3(C). The hair transplanting operation is controlled by predetermined data which is stored in a control unit (a computer, not shown) for determining the transplant pitch and the coloring of the artificial hair 30, etc. The color scheme of the artificial hair 30 is determined by given combination of the hairs to be unreeled from the respective bobbins 31A–31D. By way of example, combination of 50% of the hair from the bobbin 31A, 30% from the bobbin 31B, 15% from the bobbin 31C and 5% from the bobbin 31D will give a specific color to the artificial hair 30 to be transplanted at the station 4.

Before starting the hair transplanting operation at the station 4, the artificial hair 30 has been supplied to below the base 11. This is carried out by the vacuum generators 32, 33 which are driven in response to a command from the control unit to absorb the artificial hair 30 toward the station 4. When the artificial hair 30 of a specific color reeled around the bobbin 31A is to be selected, ports "1-A" and "2-A" of the electromagnetic valve 39*a* (FIG. 8) in the vacuum generator 32 are turned on, and a motor for rotation the bobbin 31A is energized. When the artificial hair 30 of another color reeled around the bobbin 31B is to be selected, ports "1-B" and "2-B" of the electromagnetic valve 39*a* are turned on, and another motor for rotation the bobbin 31B is energized. When the artificial hair 30 of still another color reeled around the bobbin 31B is to be selected, ports "3-A"

and "4-A" of the electromagnetic valve 39*a* are turned on, and still another motor for rotation the bobbin 31C is energized. When the artificial hair 30 of yet another color reeled around the bobbin 31D is to be selected, ports "3-B" and "4-B" of the electromagnetic valve 39*a* are turned on, and yet another motor for rotation the bobbin 31D is energized. When the sensor 38 (FIG. 10) detects that the artificial hair 30 reaches a predetermined length, it is cut by the cutter 34 (FIG. 5(A)). The artificial hair segment 30 of a predetermined length is positioned below the base 11, as shown in FIGS. 10A–10D.

After the artificial hair segment 30 has been supplied to below the base 11, it is transplanted onto the base 11 in the following manner. First, the movable guide 36 is moved with respect to the stationary guide 37 to open the conduit 35, the needle 41 descends toward the gap G2 between the guides 36, 37 (FIG. 5(B), FIGS. 11(A)–(B)) so that the hook of the needle penetrates the base 11. The press block 47 moves toward the stationary block 48 to engage the artificial hair 30 therebetween (FIG. 5(C)). The needles 41*a* and 41*b* are positioned in the gap G2 in opposition to each other across the block 47. Then, these needles are elevated. As the needles 41*a*, 41*b* ascend, the artificial hair 30 is pulled above in engagement with the hook 45 of the needles 41*a*, 41*b* at opposite sides of the block 47, while a portion of the artificial hair 30 is held between the blocks 47, 48 (FIGS. 5(D)–(E), FIG. 12(A)–(B)). The block 47 is then separated from the block 48 so that a portion 30a of the artificial hair 30 is transplanted to the base 11 (FIG. 5(F)). Since the artificial hair 30 has been cut to a predetermined length, the opposite ends of the artificial hair segment 30 separate from the hook 45 when the needle 41 ascends to the uppermost position (which is just above the position shown in FIG. 5(F)), and then subjected to an air flow from the fan 51 (FIG. 7(A)). Meanwhile, the artificial hair 30 unhooked from the needle 41 is absorbed by static electricity generated by the static electricity generator 52 (FIG. 7(B)). By cooperation of the fan 51 and the static electricity generator 52, the artificial hair segment 30 is sprawled out over the base 11, with an intermediate portion being transplanted on the base 11 (FIG. 7(C)). It seems as if two artificial hairs were transplanted on the base 11. The hair transplantation is carried out at different points which may be arranged at a predetermined pitch (P) of 2 mm, for example, along the X and/or Y axes, in predetermined order. Once the hair transplantation to a specific point is over, the conveyor table 21 is moved such that the needle 41 is positioned just above the next point of transplantation on the base 11.

Figure 14A:
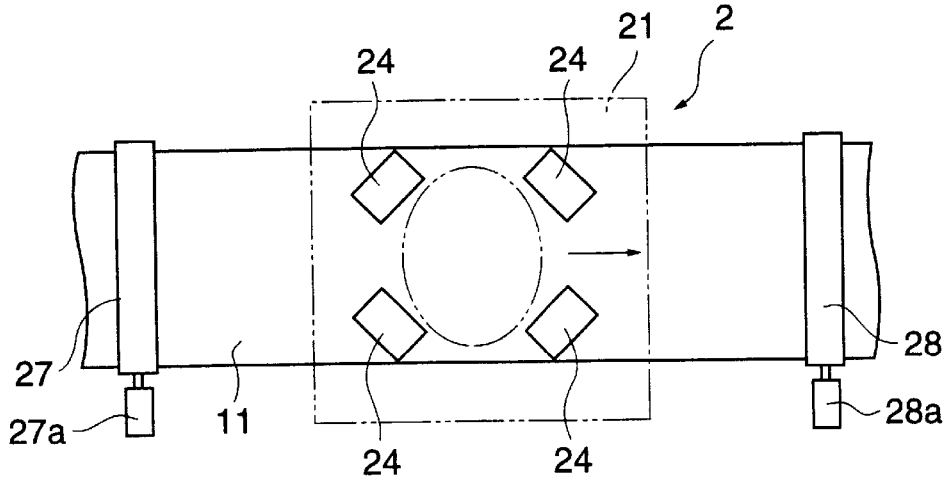
FIGS. 14(A)–(B) are explanatory views of the manner how to discharge the base with the artificial hairs having been transplanted thereon and feed another blank base sheet onto the conveyor table.
Figure 14B:
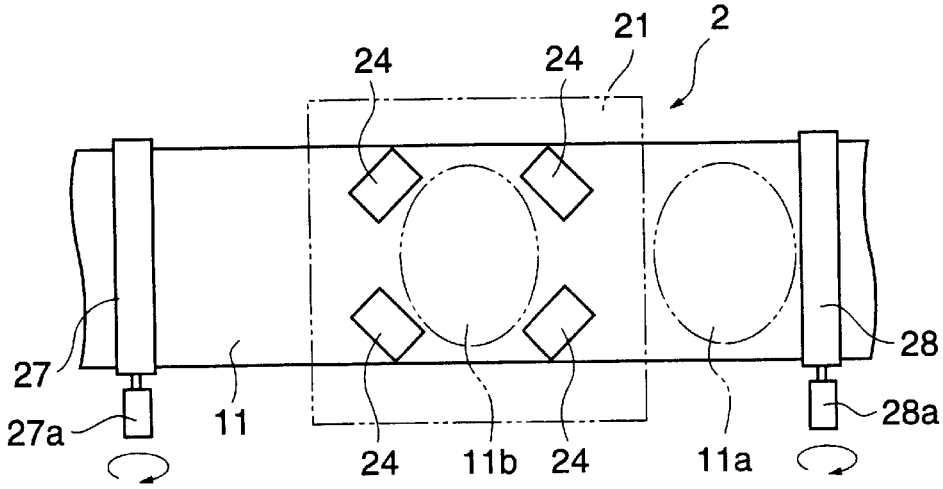

When the hair transplantation is completed at predetermined plural points on the base 11, the base 11 is released from being stretched and is discharged by the discharge rollers 28 (FIG. 14(A)). The feeder rollers 27 feeds the base 11 over a predetermined stroke, so that the base 11*a* with the transplanted hairs is discharged out of the tensioning/positioning station 2, and another base 11*b* is positioned above the table 21 (FIG. 14(B)).

The discharged base 11(11*a*) is fed to a first adhesive applying station B where a first adhesive applying unit 6 applies first adhesive 61 for adhering the transplanted hair segment 30 to the underside of the base 11 on which the artificial hairs 30 have been transplanted at the hair transplanting station A. The first adhesive applying unit 6 comprises a tank 62, the first adhesive 61 in the tank 62, and nozzles 63 driven by the air-compressor 39 to spray the first adhesive 61 onto the underside of the base 11. The adhesive 61 sprayed from the nozzles 63 will adhere the intermediate or base portion 30*a* (FIG. 5(F)) of the artificial hair segment 30 to the underside of the base 11. The adhesive 61 is preferably of a quick-drying nature. It contains a hardening agent which is hardened when subjected to high-temperature and high-pressure at a forming station D.

The base 11 is then fed to a cutting station C where the base, to which the first adhesive 61 has been applied at the station B, is cut into a predetermined two-dimensional shape by a cutter unit 7 including a cutter 71.

The base 11 is then fed to the forming station D where it is subjected to high-temperature and high-pressure in a forming unit 8 to be formed into a predetermined three-dimensional configuration. The forming unit 8 comprises, for example, a mold 81 having a cavity of a shape corresponding to a human head.

The three-dimensionally shaped base 11 is then fed to a second adhesive applying station E where a second adhesive applying unit 9 applies second adhesive 91 to the interior of the three-dimensional base 11. The second adhesive applying unit 9 comprises a tank 92, the second adhesive 91 in the tank 92, and nozzles 93 driven by the air-compressor 39 to spray the second adhesive 91 onto the first adhesive 61 which has already been hardened with high-temperature and high-pressure applied at the forming station D. Thus, a wig is manufactured. The second adhesive 91 provides suitable fittability of the wig to a human head.

The operation at the respective stations A–E is controlled by a control unit which may typically comprises a computer (not shown). The operation at the hair transplanting station A will be described in more detail in reference to the flowcharts of FIGS. 16–33.

The apparatus is empowered at S1 and the respective units in the apparatus is initialized at S2. When all units have been initialized, a READY signal is supplied to the computer at S3. The computer awaits receipt of the READY signal at S4. Once the computer receives the READY signal (YES at S4), it is discriminated if there is a sheet of the base 11 between the discharge rollers 28, at S5. When there is the base 11 (YES at S5), the sheet feeding operation is carried out at S6, which will be described in detail in reference to the flowchart of FIG. 30, and the sheet loosening operation is carried out at S7 wherein the discharge rollers 28 are driven to rotate in forward direction for giving a slack to the artificial hair 30 which has been fed to the hair transplanting station A. The sheet feeding operation and the sheet loosening operation will be described in detail in reference to the flowcharts of FIGS. 30–32 respectively. When no base 11 is found between the discharge rollers 28 (NO at S5), the computer determines that the apparatus is in an error level 9, indicating no base sheet, at S8, and the procedure is returned to S5.

Then, the tensioning motor 26*a* rotates clockwise, the tensioning motor 26*b* rotates counterclockwise, the tensioning motor 26*c* rotates clockwise and the tensioning motor 26d rotates counterclockwise, at S9*a*–S9*d*. It is then discriminated if cam sensors (not shown) are ON or OFF at S10*a*–S10*d*. When the cam sensor is ON (YES at S10*a*–S10*d*), the corresponding tensioning motor 26*a*–26*d* is turned off, at S11*a*–S11*d*. When the cam sensor is OFF (NO at S10*a*–S10*d*), the procedure is returned to S9*a*–S9*d*. Variables for determining the amount of rotation of the tensioning motors 26*a*–26*d* are initialized at S12*a*–S12*d*. It is discriminated if the tensioning motors 26*a*–26*d* has been driven to rotate over a predetermined amount, at S13*a*–S13*d*. More specifically, it is confirmed at S13*a*–S13*d* if the sheet base 11 has already been stretched to a satisfactory level. If not (NO at S13*a*–S13*d*), the tensioning motor 26*a* rotates counterclockwise, the tensioning motor 26*b* rotates clockwise, the tensioning motor 26*c* rotates counterclockwise and the tensioning motor 26*d* rotates clockwise, at S15*a*–S15*d*, and the amount of rotation of the respective motors 26*a*–26*d* is count at S16*a*–S16*d*. Then, the tensioning motors 26*a*–26*d* are turned off at S14*a*–S14*d*. Through the procedure through S9*a*–S9*d* to S14*a*–14*d*, the sheet base 11 supplied onto the table 21 is nipped between the tensioning nip rollers 24, 25 and become stretched.

Figure 33:
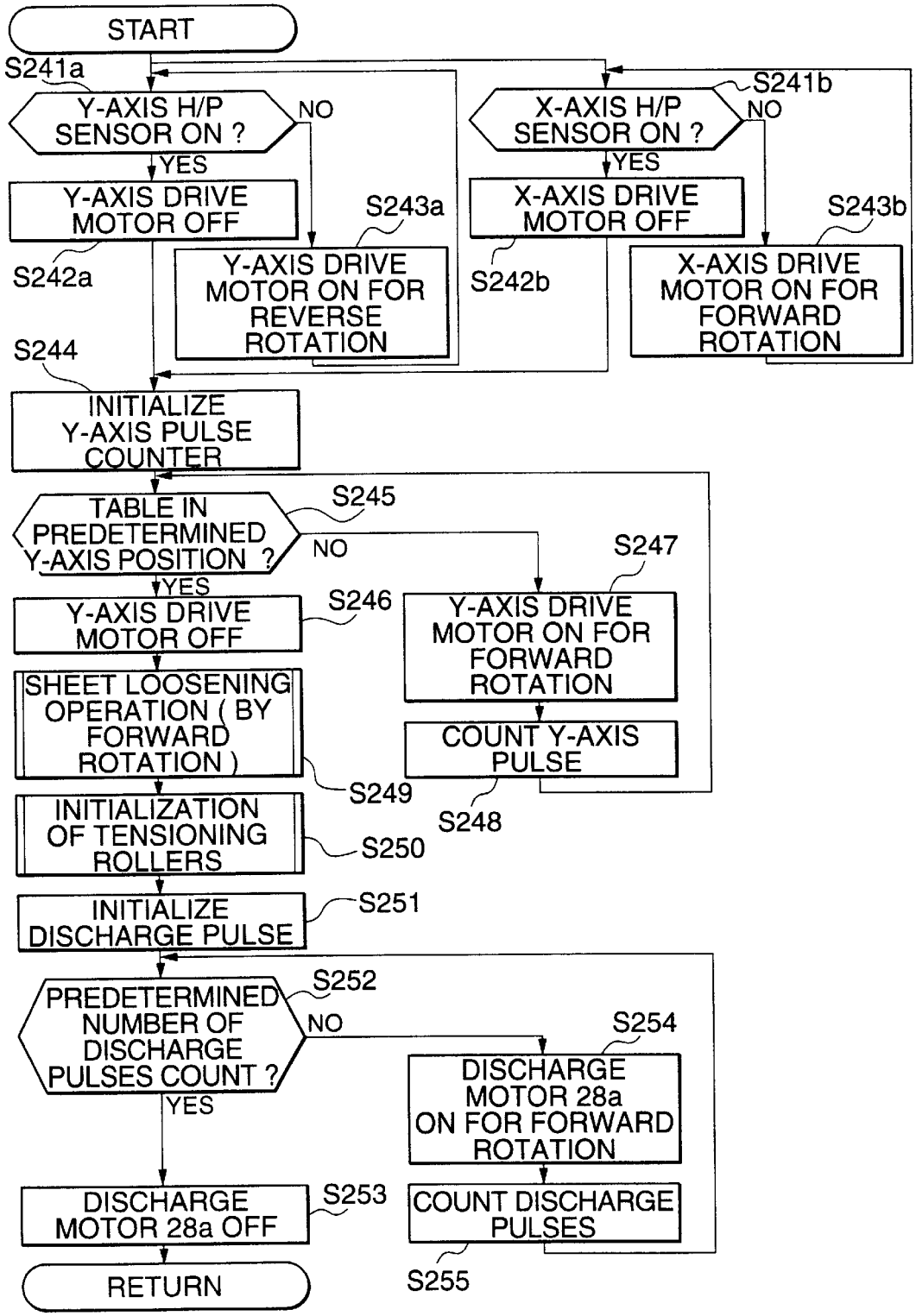
FIG. 33 is a flowchart of sheet discharging operation (S24) in FIG. 18.

Then, the sheet feeding operation is carried out at S17 and the sheet loosening operation is carried out at S18. In response to receipt of predetermined data at S19, the coordinate data are read out at S20. It is discriminated if the coordinate data have been read out at S21. After the coordinate data have been read out (YES at S21), the X-axis drive motor for moving the table 21 along the X-axis stops at S22, and the Y-axis drive motor also stops at S23. Next, the discharging operation which will be described in detail in reference to the flowchart of FIG. 33 is carried out at S24. If the coordinate data have not been read out (NO at S21), the procedure advances to S25 where it is discriminated if the coordinate data designates predetermined position. If so (YES at S25), the X-axis and Y-axis drive motors for the table 21 are caused to stop at S26 and S27, respectively. Thus, the positioning of the table 21 has been completed, and the next hair transplanting operation is to be carried out at S28. If the coordinate data read out at S20 do not designate the predetermined position (NO at S25), the X-axis drive motor for the table 21 is turned on at S29, and it is then discriminated at S30 if an X-axis limit sensor (not shown) is ON or OFF. If the sensor is ON (YES at S30), the X-axis drive motor for the table 21 is caused to stop at S31. If there is an ERROR 11 at S32, the procedure is returned to S2. If the sensor is OFF (NO at S30), it is then discriminated at S33 if a Y-axis limit sensor (not shown) is ON or OFF. If the sensor is ON (YES at S33), the Y-axis drive motor for the table 21 is caused to stop at S34. If there is an ERROR 12 at S35, which indicates that an X-axis H/P (home position) sensor (not shown) and the X-axis drive motor could be out of order, the procedure is returned to S2. When the sensor is OFF (NO at S33), it is then discriminated at S36 if the Y-axis limit sensor is ON or OFF. If the sensor is ON (YES at S36), the procedure advances to S34. If the sensor is OFF (NO at S36), the Y-axis drive motor for the table 21 is turned on at S37, and the procedure is returned to S25.

The initialization of the respective units at S2 will be described in more detail in the flowcharts of FIGS. 19–23. In reference to the flowchart of FIG. 19, it is first discriminated at S201 if a sensor (not shown) for detecting the artificial hairs 30 of different colors reeled around the bobbins 31 is ON or OFF. If the sensor is ON (YES at S201), the feeder rollers 27 are initialized at S203 in such manner as will be described in reference to the flowchart of FIG. 20. If the sensor is still OFF (NO at S201), there is an ERROR LEVEL 7 indicating no insertion of the artificial hair into the bobbin at S202, and the procedure is returned to S201. The tensioning rollers 23 in the tensioning/positioning station 2 and the needle 41 in the hair transplanting unit 4 are set to the respective initial position at S204 and S205. The table 21 is then set to the initial position at S206.

Figure 20:
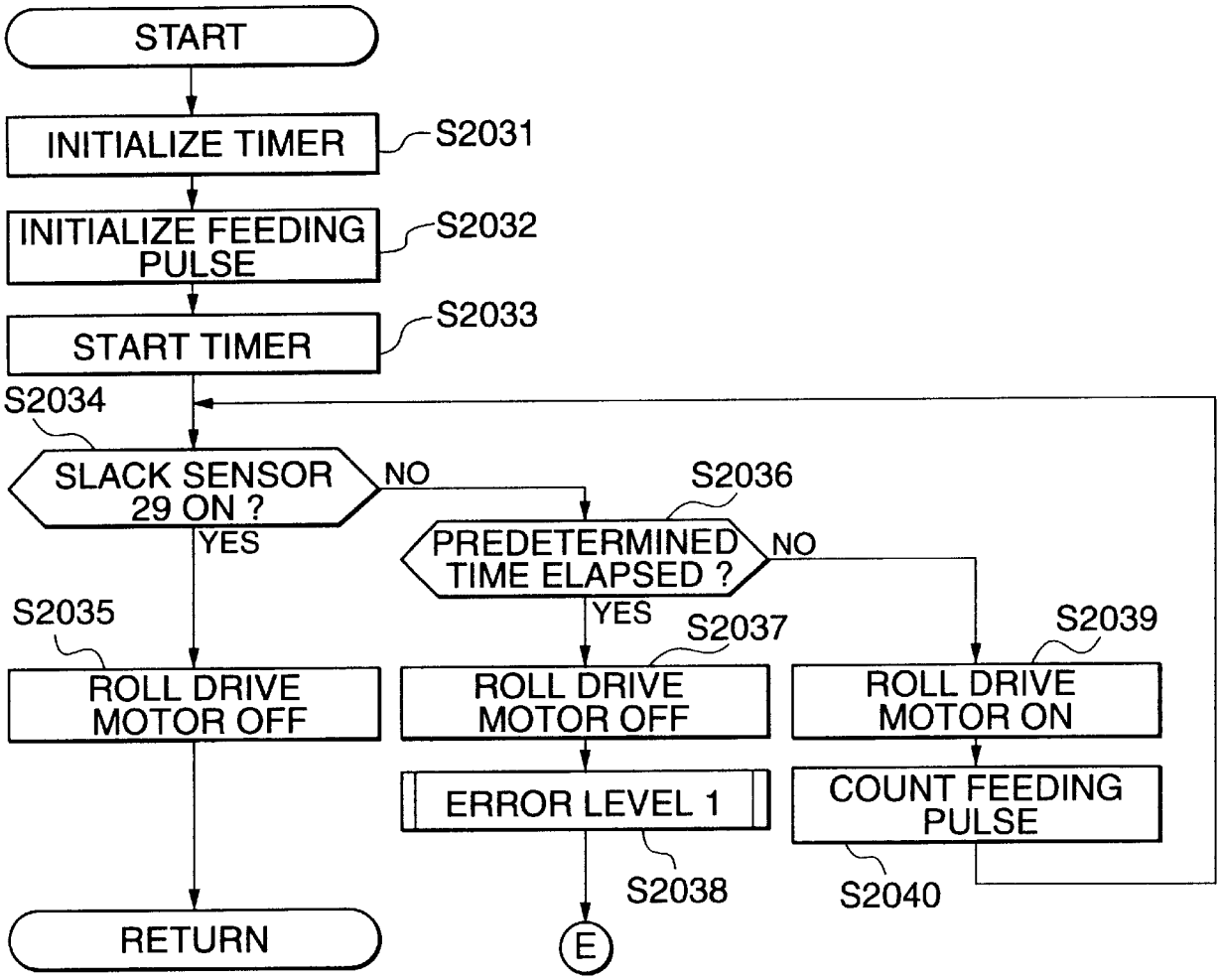
FIG. 20 is a flowchart of feeder roll initialization (S203) in the flowchart of FIG. 19.

The bobbin initialization carried out at S203 is shown in more detail in the flowchart of FIG. 20. A timer (not shown) is first initialized at S2031 and the variation determining the amount of rotation of the feeder rollers 27 is initialized at S2032. The timer starts at S2033. It is discriminated at S2034 if the slack sensor 29 is ON or OFF. If the slack sensor 29 is already ON (YES at S2034), the drive motor for the feeder rollers 27 is turned off at S2035, and the procedure is returned to the flowchart of FIG. 19. If the slack sensor 29 is still OFF (NO at S2034), it is then discriminated at S2036 if the timer reached to a predetermined count. If so (YES at S2036), the drive motor for the feeder rollers 27 is turned off at S2037. At S2038, there is an ERROR LEVEL 1 indicating no base sheet, and the procedure is returned to S201. If the timer does not reach the predetermined count (NO at S2036), the drive motor for the feeder rollers 27 is turned on at S2039, the amount of rotation of the feeder rollers 27 is count at S2040, and the procedure is returned to S2034.

Figure 21:
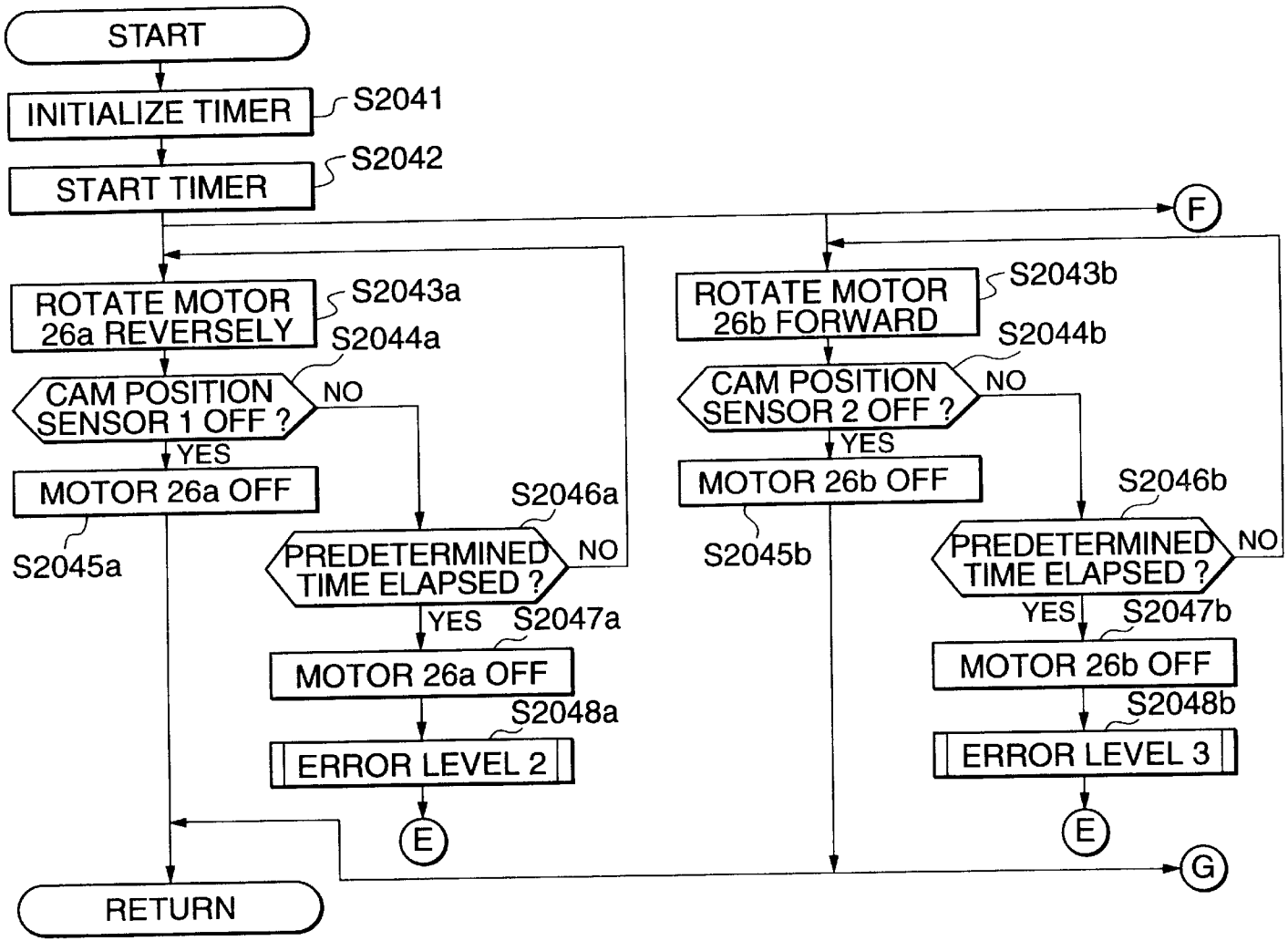
FIGS. 21–22 show a flowchart of tensioning roller initialization (S204) in the flowchart of FIG. 19.
Figure 22:
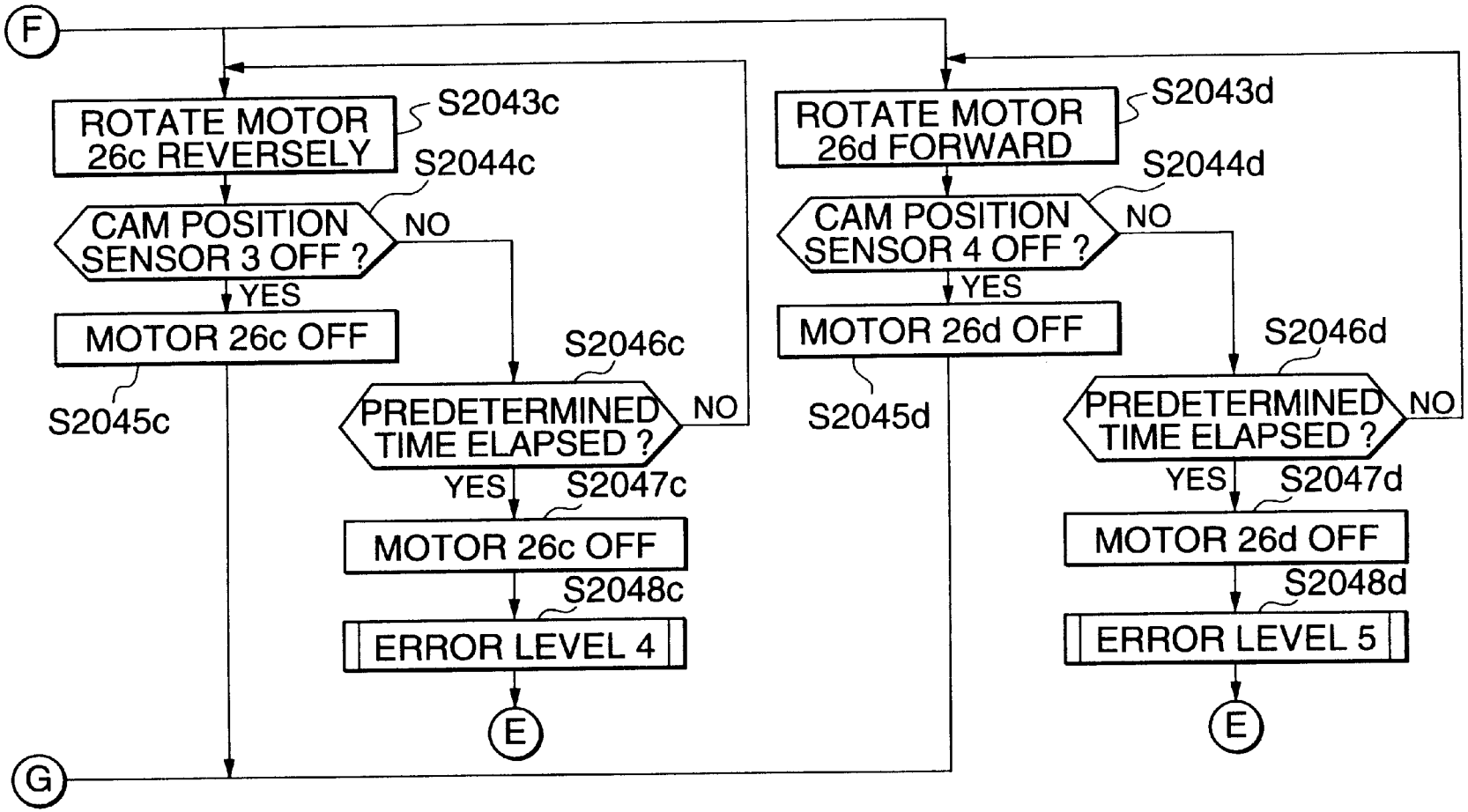

The initialization of the tensioning rollers carried out at S204 is shown in more detail in the flowcharts of FIGS. 21–22. After the timer is initialized at S2041, it starts at S2042. The tensioning motor 26*a* rotates counterclockwise, the tensioning motor 26*b* rotates clockwise, the tensioning motor 26*c* rotates counterclockwise and the tensioning motor 26*d* rotates clockwise at S2043*a*–S2043*d*. It is then discriminated at S2044*a*–S2044*d* if cam position sensors (not shown) are ON or OFF. If the cam position sensor is ON (YES at S2044*a*–S2044*d*), the corresponding tensioning motor 26*a*–26*d* is stopped at S2045*a*–S2045*d*, and the procedure is returned to the flowchart of FIG. 19. If the cam position sensor is OFF (NO at S2044*a*–S2044*d*), it is then discriminated at S2046*a*–S2046*d* if the timer has reached a predetermined count. If so (YES at S2046*a*–S2046*d*), the corresponding tensioning motor 26*a*–26*d* is stopped at S2047*a*–S2047*d*. If there is an ERROR LEVEL 2, 3, 4 or 5 at S2048*a*–S2048*d*, which indicates that the tensioning roller 23 is out of order, the procedure is returned to S201. If the timer has not yet reached a predetermined count (NO at S2046*a*–S2046*d*), the procedure is returned to S2043*a*–S2043*d*.

Figure 23:
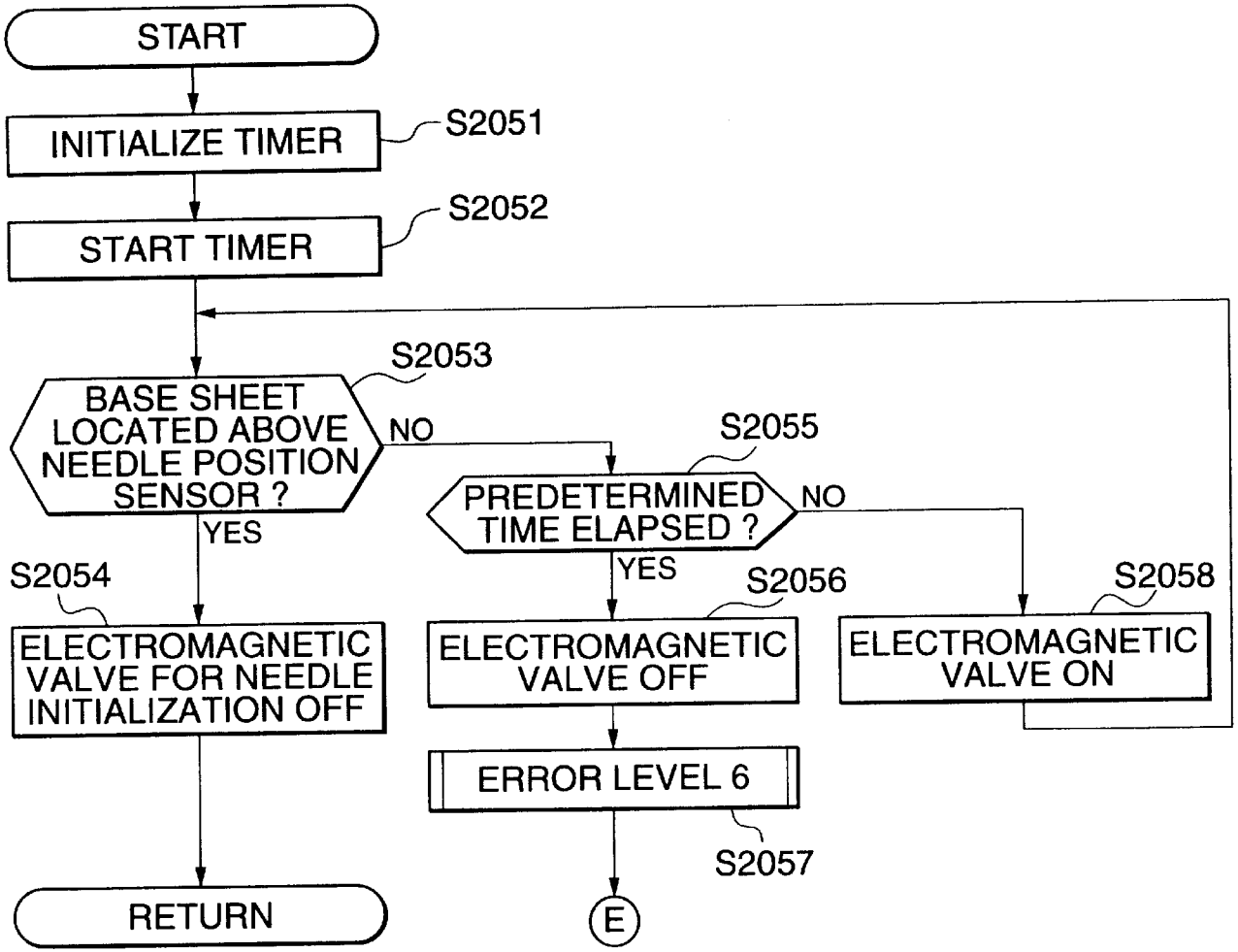
FIG. 23 is a flowchart of needle initialization (S205) in the flowchart of FIG. 19.

The needle initialization carried out at S205 is shown in more detail in the flowchart of FIG. 23. The timer is initialized at S2051 and caused to start at S2052, it is then discriminated at S2053 if there is the base sheet above a needle position sensor (not shown). If there is the base sheet above the needle position sensor (YES at S2053), an electromagnetic valve for initialization of the needle 41 is stopped at S2054, and the procedure is returned to the flowchart of FIG. 19. If not (NO at S2053), it is discriminated at S2055 if the timer has reached a predetermined count. If the timer has already reached a predetermined count (YES at S2055), the electromagnetic valve for needle initialization is stopped at S2056. When there is an ERROR LEVEL 6 at S2057 indicating that the needle unit would be out of order, the procedure is returned to S201. If the timer has not yet reached a predetermined count (NO at S2058), the electromagnetic valve for needle initialization is turned on at S2058, and the procedure is returned to S2053.

Figure 24:
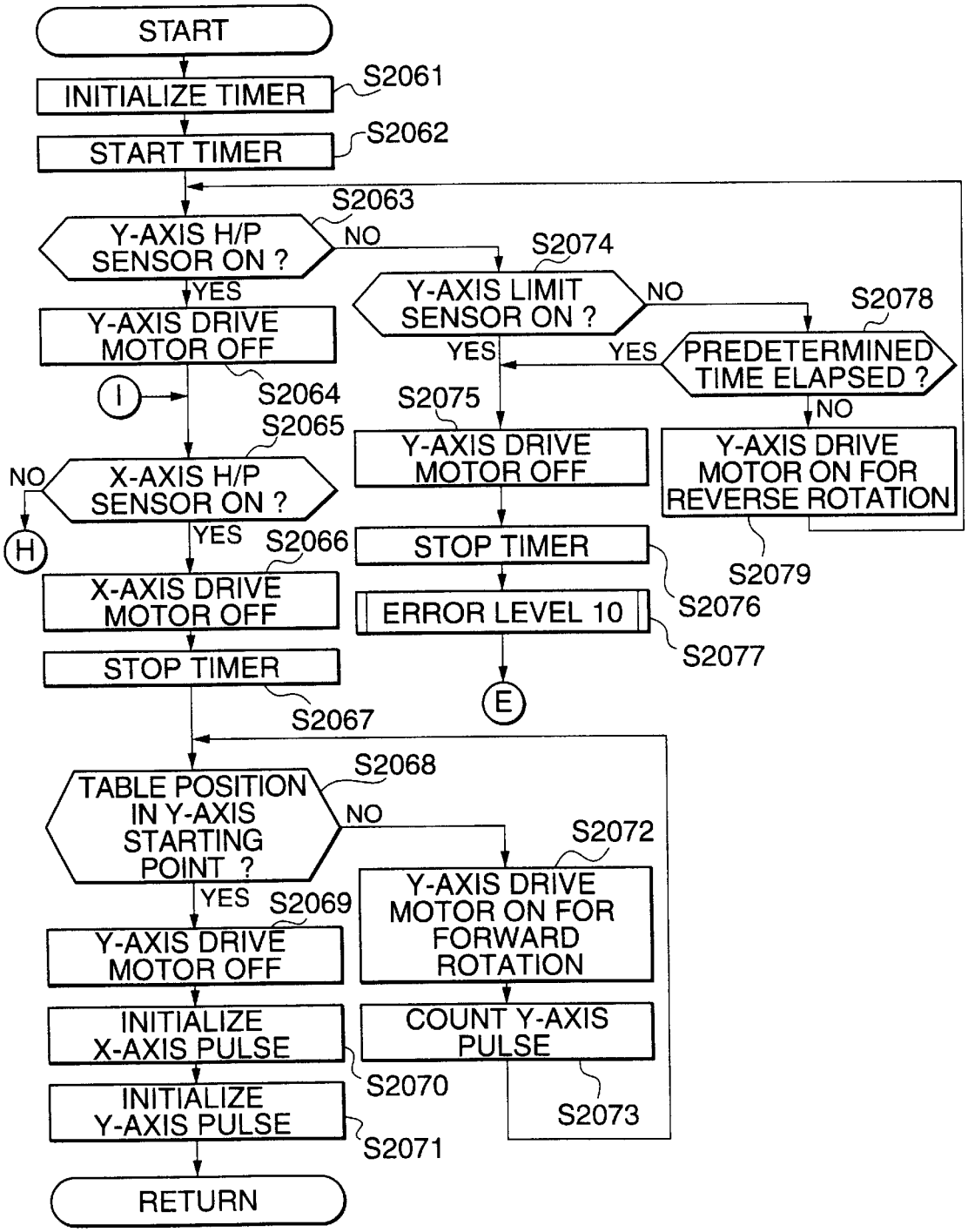
FIGS. 24 and 25 s how a flowchart of table initialization (S206) in the flowchart of FIG. 19.
Figure 25:
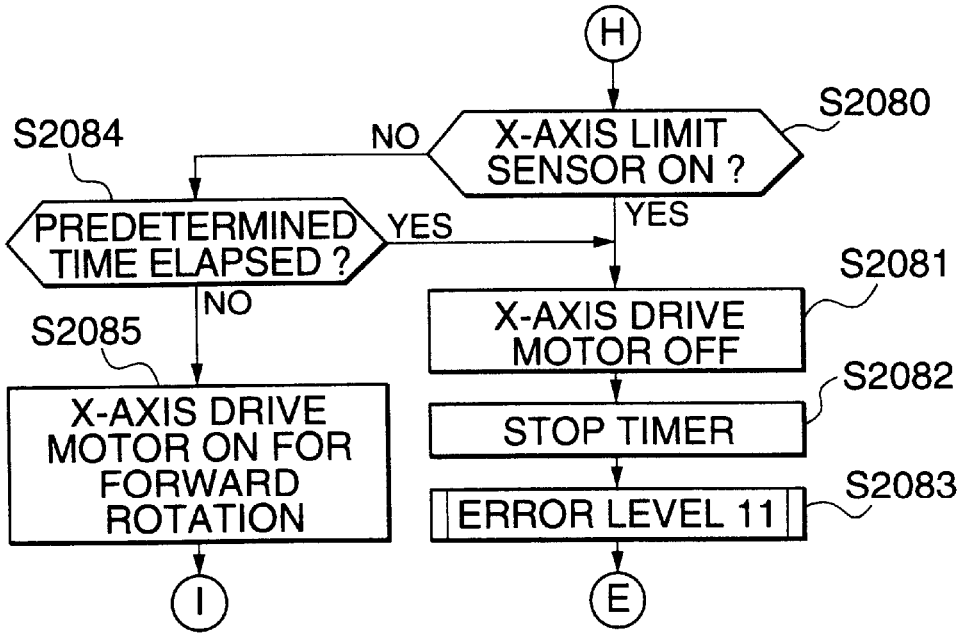

The table initialization carried out at S206 is shown in more detail in the flowchart of FIGS. 24–25. The timer is initialized at S2061 and caused to start at S2062. It is then discriminated at S2063 if a Y-axis H/P (home position) sensor (not shown) is ON or OFF. If the Y-axis HIP sensor is already ON (YES at S2063), the Y-axis drive motor for the table 21 is turned off at S2064. Next, it is discriminated at S2065 if the X-axis HIP sensor is ON or OFF. If the X-axis HIP sensor is already ON (YES at S2065), the X-axis drive motor for the table 21 is turned off at S2066, and the timer stops at S2067. It is then discriminated at S2068 if the table position agrees with the starting point on the Y-axis at which the hair transplantation should start. If the table 21 has already reached the Y-axis starting point (YES at S2068), the Y-axis drive motor for the table 21 is turned off at S2069. The variations determining the amounts of movement along the X- and Y-axes are initialized at S2070 and S2071, and the procedure is returned to the flowchart of FIG. 19. If the table 21 has not yet reached the Y-axis starting point (NO at S2068), the Y-axis drive motor is turned on to rotate in a forward direction at S2072. The amount of movement of the table 21 along the Y-axis is count at S2073. S2072 and S2073 are repeated until the table 21 reached the Y-axis starting point (i.e., until discrimination at S2068 produces a YES result).

If the Y-axis HIP sensor is still OFF (NO at S2063), it is discriminated at S2074 if the Y-axis limit sensor is ON or OFF. If the Y-axis limit sensor is already ON (YES at S2074), the Y-axis drive motor for the table 21 is turned off at S2075, and the timer stops at S2076. When there is an ERROR LEVEL 10 at S2077, indicating that the Y-axis HIP sensor and the Y-axis drive motor are both out of order, the procedure is returned to S201. If the Y-axis limit sensor is still OFF (NO at S2074), it is then discriminated at S2078 if the timer has reached a predetermined count. If this is confirmed (YES at S2078), the procedure advances to S2075 where the Y-axis drive motor is turned off. If not (NO at S2078), the Y-axis drive motor is turned on to rotate in a reverse direction at S2079, and the procedure is returned to S2063.

If the X-axis HIP sensor is still OFF (NO at S2065), it is then discriminated at S2080 if the X-axis limit sensor is ON or OFF. If it is already ON (YES at S2080), the X-axis drive motor is turned off at S2081, and the timer stops at S2082. When there is an ERROR LEVEL 11 due to malfunction at S2083, the procedure is returned to S201. If the X-axis limit sensor is still OFF (NO at S2080), it is then discriminated at S2084 if the timer has reached a predetermined count. If this is confirmed (YES at S2084), the procedure advances to S2081. If not (NO at S2084), the X-axis drive motor is turned on to rotate in a forward direction at S2085, and the procedure is returned to S2065.

Figure 26:
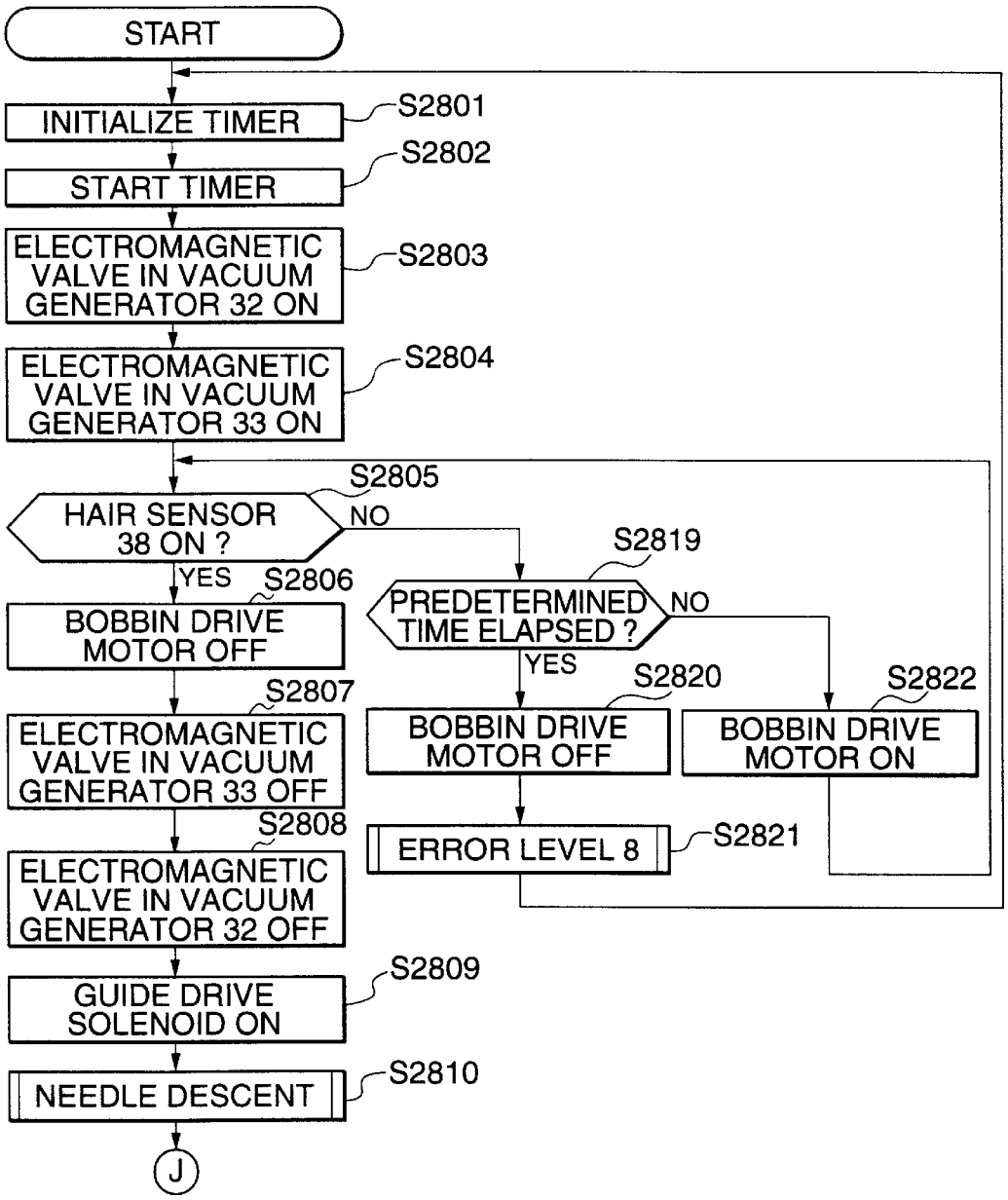
FIGS. 26–27 show a flowchart of hair transplanting operation (S28) in FIG. 18.
Figure 27:
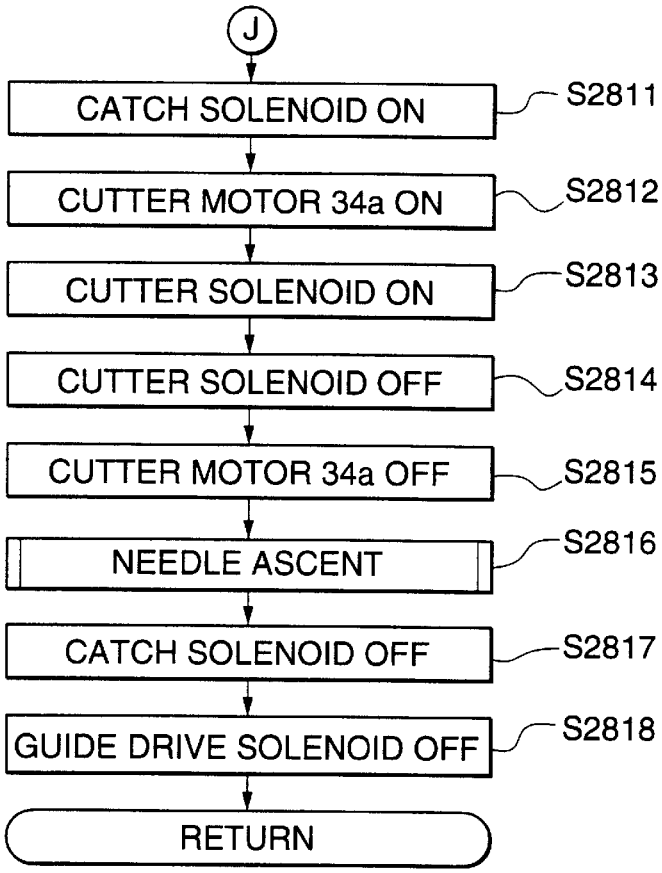

The hair transplantation will now be described in reference to the flowchart of FIGS. 26–27. The timer is initialized at S2801 and starts at S2802. The electromagnetic valve in the vacuum generator 32 is turned on at S2803. The electromagnetic valve in the vacuum generator 33 is also turned on at S2804. It is then discriminated at S2805 if the hair sensor 38 is ON or OFF. If the sensor 38 is already ON (YES at S2805), a motor (not shown) for driving the respective bobbins 31 is turned off at S2806. The electromagnetic valve in the vacuum generator 33 is turned off at S2807 and the electromagnetic valve in the vacuum generator 32 is turned off at S2808. The solenoid for driving the movable guide 36 is turned on so that is separates from the stationary block 37, at S2809. Then, the needle 41 descends at S2810, which will be described in detail in reference to the flowchart of FIG. 28. A catch solenoid is turned on at S2811, and the cutter motor 34*a* is turned on at S2812. A cutter solenoid is turned on at S2813. After the cutter solenoid is turned off at S2814, the cutter motor 34*a* is turned off at S2815. The artificial hair 30 is cut into a hair segment of a predetermined length through a sequence of operation at S2811–S2815. Then, the needle 41 ascends at S2816, which will be described in detail in reference to the flowchart of FIG. 29. Then, the catch solenoid is turned off at S2817, and the solenoid for driving the movable guide 36 is turned off at S2818, so that the movable guide 36 becomes closed with respect to the stationary guide 37. Then, the procedure is returned to S2801 of FIG. 26. If the sensor 38 is still OFF (NO at S2805), it is discriminated at S2819 if the timer reached a predetermined count. If this is confirmed (YES at S2819), the motor for driving the respective bobbins 31 is turned off at S2820. When there is an ERROR LEVEL 8 at S2821, indicating no artificial hair 30 in the bobbin 31, clogging-up of the conduit with hair or malfunction of the sensor, the procedure is returned to S2801. If the timer has not yet reached a predetermined count (NO at S2819), the motor for driving the respective bobbins 31 is turned on at S2822, and the procedure is returned to S2805.

Figure 28:
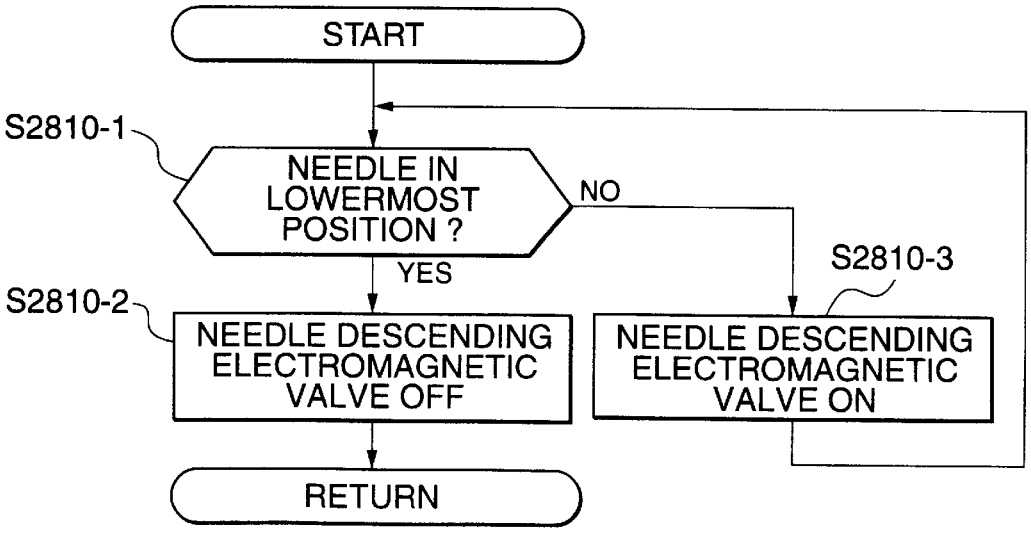
FIG. 28 is a flowchart of needle descending operation (S2810) in FIG. 26.

The needle descent is carried out as shown in the flowchart of FIG. 28. It is first discriminated at S2810-1 if a needle position sensor (not shown) detects that the needle 41 is currently in its lowermost position. If so (YES at S2810-1), a needle descending electromagnetic valve (not shown) in the hydraulic cylinder 49 is turned off at S2810-2, and the procedure is returned to the flowchart of FIGS. 26–27. If the current needle position is not in its lowermost position (NO at S2810-1), the needle descending electromagnetic valve is turned on at S2810-3, and the procedure is returned to S2810-1.

Figure 29:
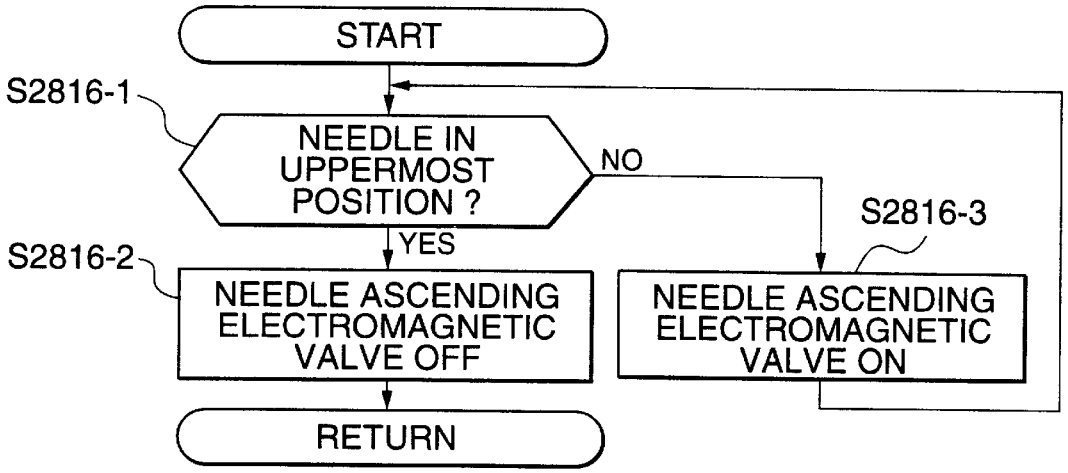
FIG. 29 is a flowchart of needle ascending operation (S2816) in FIG. 27.

The needle ascent is carried out as shown in the flowchart of FIG. 29. It is first discriminated at S2816-1 if the needle position sensor detects that the needle 41 is currently in its uppermost position. If so (YES at S2816-1), a needle ascending electromagnetic valve (not shown) in the hydraulic cylinder 49 is turned off at S2816-2, and the procedure is returned to the flowchart of FIGS. 26–27. If the current needle position is not in its uppermost position (NO at S2816-1), the needle ascending electromagnetic valve is turned on at S2816-3, and the procedure is returned to S2816-1.

Figure 16:
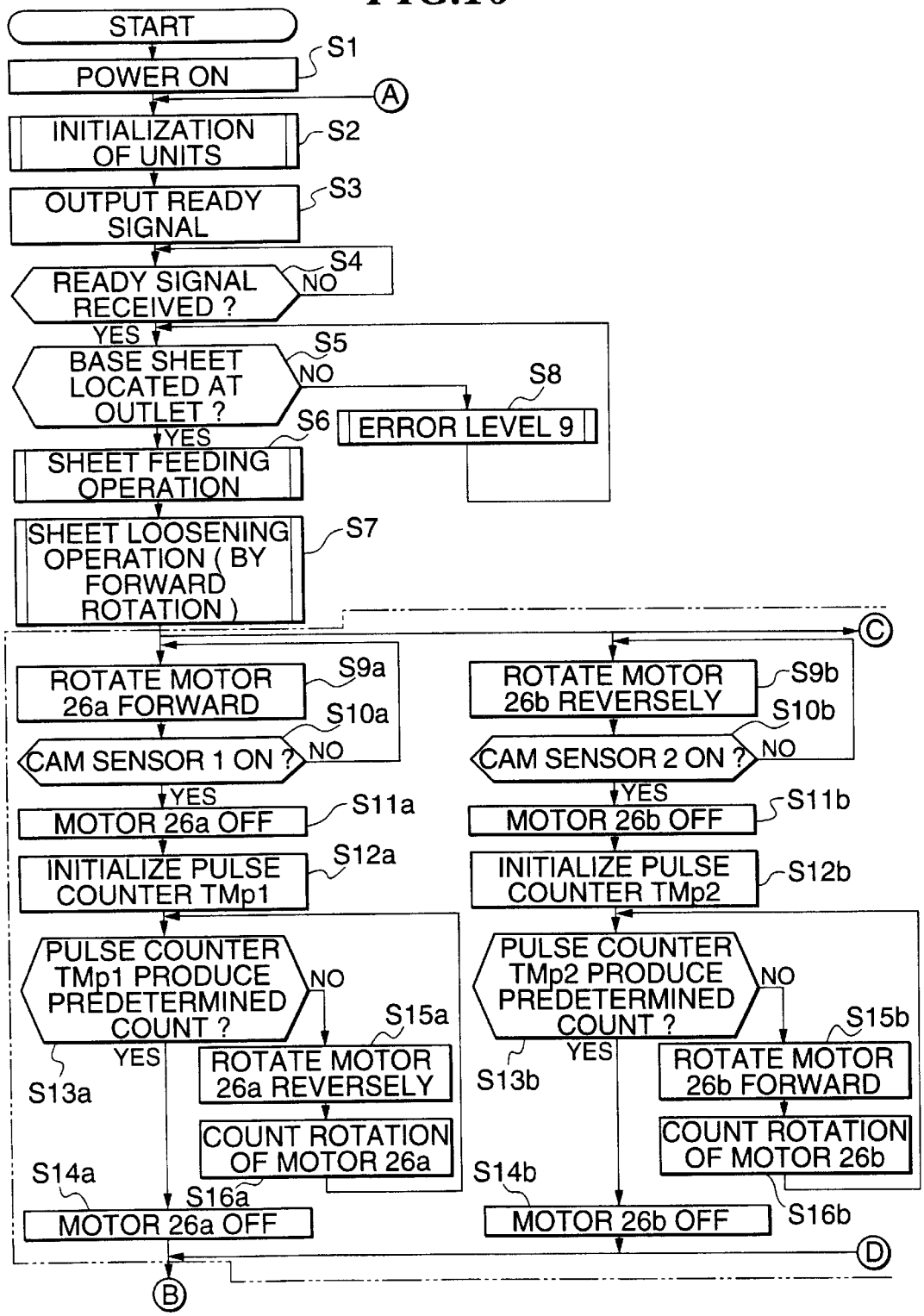
FIGS. 16–18 show a flowchart of operation carried out by the automated wig manufacturing apparatus of the present invention.
Figure 17:
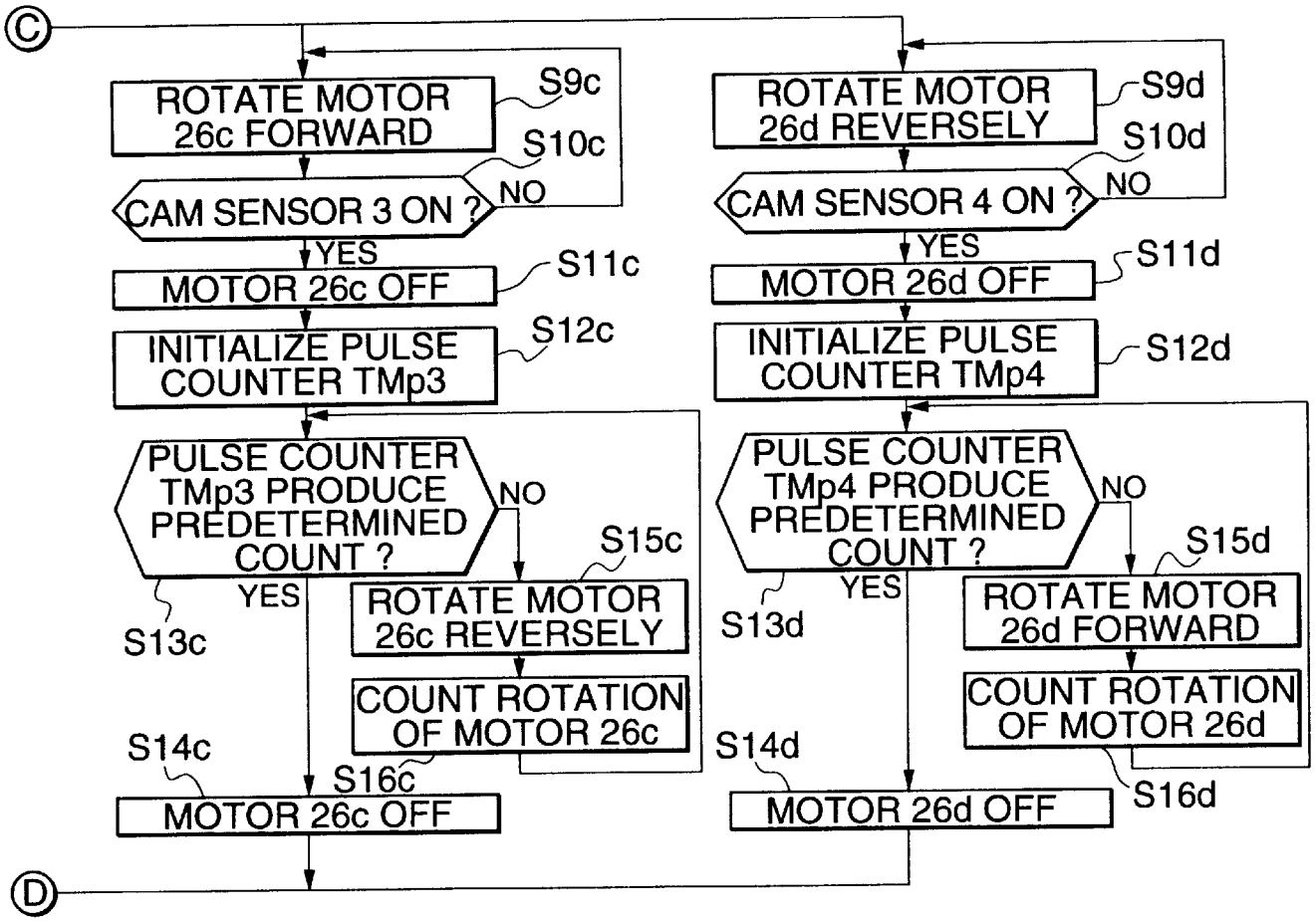
Figure 18:
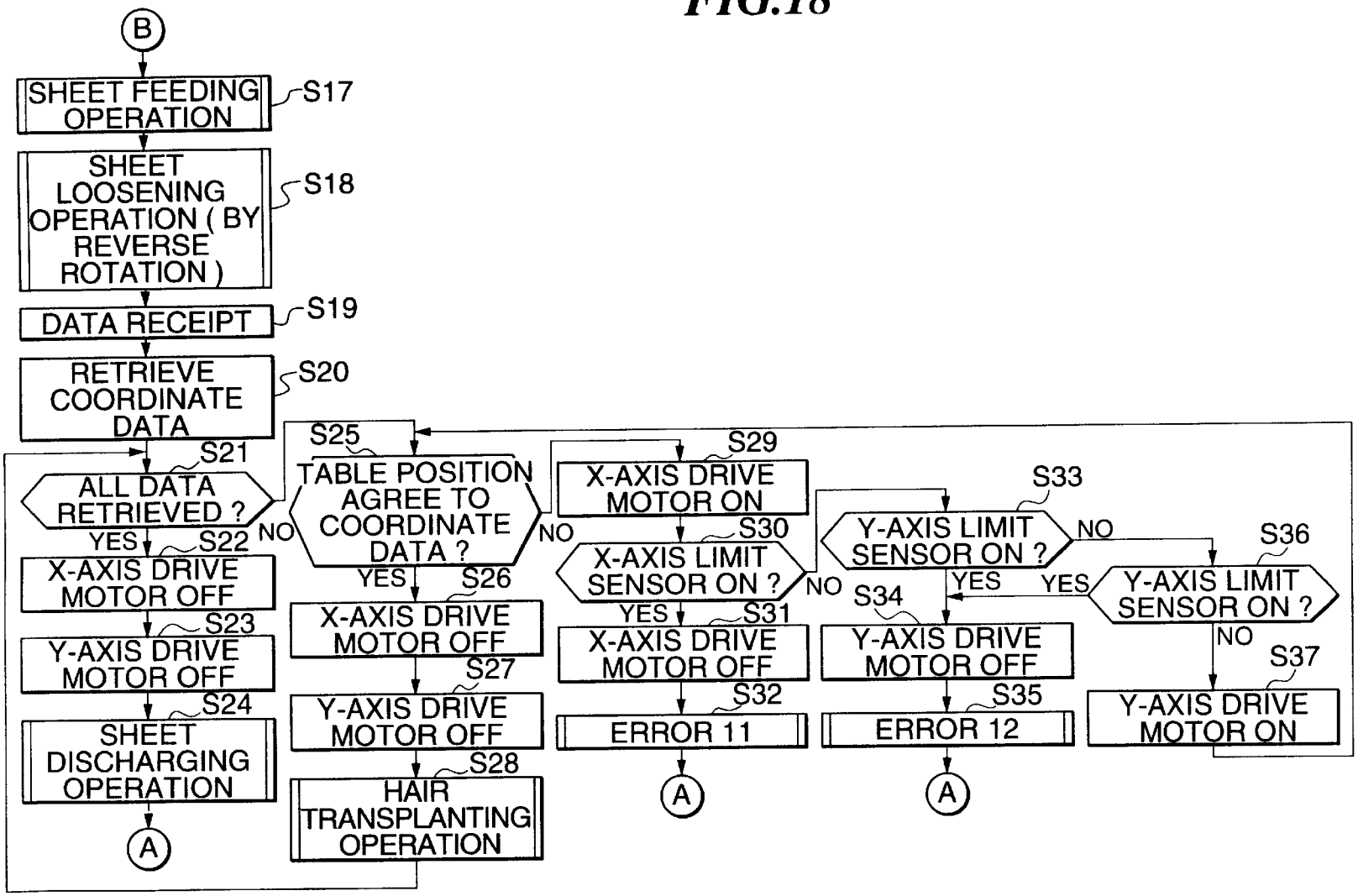
Figure 19:
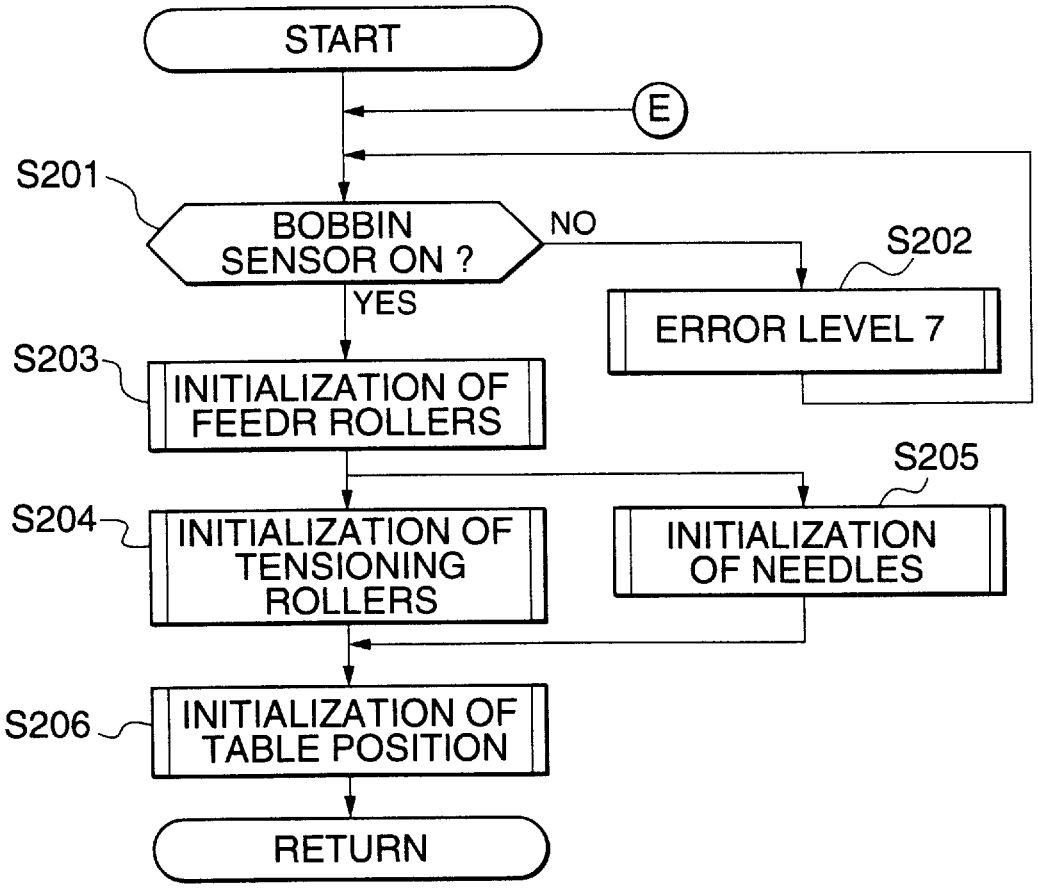
FIG. 19 is a flowchart of unit initialization (S2) in FIG. 16.
Figure 30:
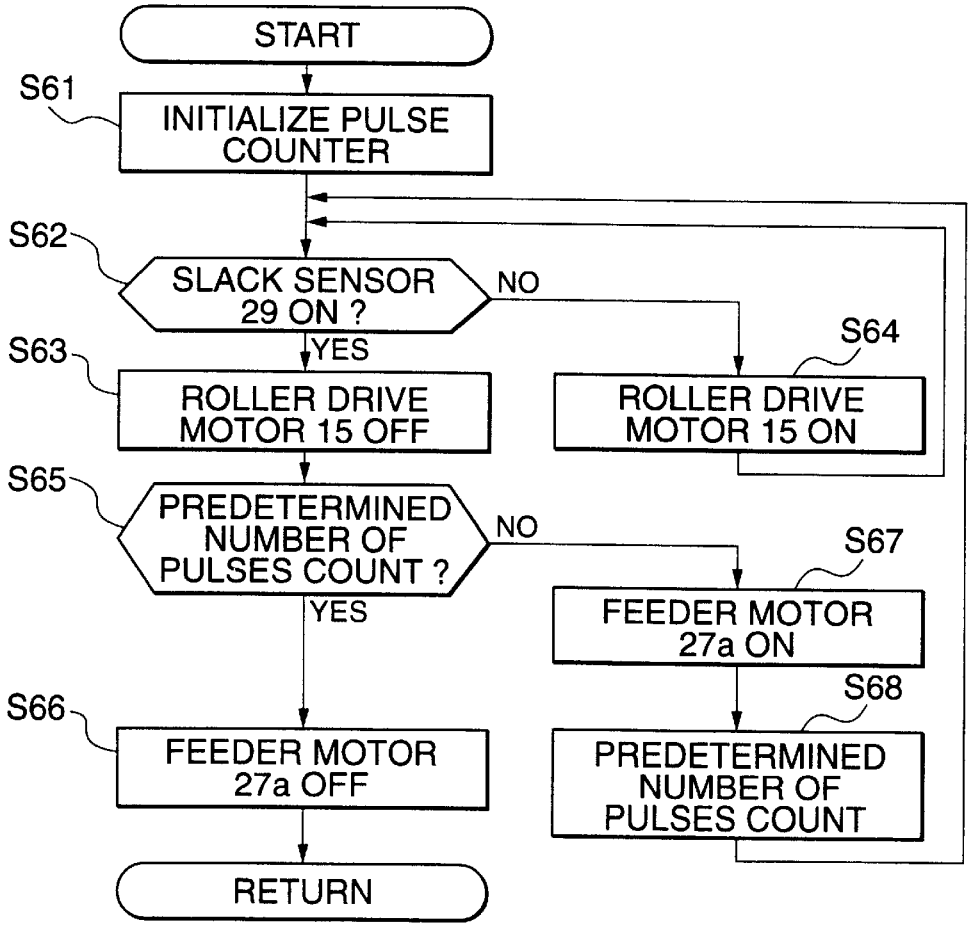
FIG. 30 is a flowchart of sheet feeding operation (S6) in FIG. 16 and (S17) in FIG. 18.

The sheet feeding operation at S6 of the flowchart of FIGS. 16–18 is carried out as shown in the flowchart of FIG. 30. The variation for determining the amount of rotation of the feeder rollers 27 is initialized at S61. It is then discriminated at S62 if the slack sensor 29 is ON or OFF. If this is already ON (YES at S62), the roller drive motor 15 is tuned off at S63. If the sensor 29 is still OFF (NO at S62), the motor 15 is turned on at S64, and the procedure is returned to S62. After the motor 15 is turned off at S63, it is discriminated at S65 if the feeder rollers 27 has been rotated over a predetermined unreel period. When a predetermined amount of the base 11 has been fed onto the table 21 (YES at S65), the drive motor 27*a* for rotating the feeder rollers 27 is turned off at S66, and the procedure is returned to the flowchart of FIGS. 16–18. If not (NO at S65), the drive motor 27*a* is turned on to drive the feeder rollers 27 at S67, and the amount of rotation of the feeder rollers 27 is count by a pulse counter (not shown) at S68. The procedure is then returned to S62.

The sheet loosening operation at S7 of the flowchart of FIGS. 16–18 is carried out by driving the discharge rollers 28 in forward direction. Referring specifically to the flowchart of FIG. 31, at first, a counter (not shown) for counting the number of forward rotation of the discharge rollers 28 is initialized at S71. It is discriminated at S72 if the number of forward rotation of the discharge rollers 28 has reached a predetermined number. When the forward rotation of the discharge rollers 28 reaches a predetermined number (YES at S72), the drive motor 28*a* for rotating the discharge rollers 28 is turned off at S73, and the procedure is returned to the flowchart of FIGS. 16–18. When the forward rotation of the discharge rollers 28 has not yet reached a predetermined number (NO at S72), the drive motor 28*a* is driven in a forward direction at S74, and the number of forward rotation of the drive motor 28*a* is count at S75. The procedure is then returned to S72. Thus, the sheet loosening operation which has been described in reference to FIGS. 9(A)–(C) should be carried out.

The sheet loosening operation at S18 of the flowchart of FIGS. 16–18 is carried out by driving the discharge rollers 28 in reverse direction. Referring specifically to the flowchart of FIG. 32, at fitst, a counter (not shown) for counting the number of reverse rotation of the discharge rollers 28 is initialized at S181. It is discriminated at S182 if the number of reverse rotation of the discharge rollers 28 has reached a predetermined number. When the reverse rotation of the discharge rollers 28 reaches a predetermined number (YES at S182), the drive motor 28*a* for rotating the discharge rollers 28 is turned off at S183, and the procedure is returned to the flowchart of FIGS. 16–18. When the reverse rotation of the discharge rollers 28 has not yet reached a predetermined number (NO at S182), the drive motor 28*a* is driven in a reverse direction at S184, and the number of reverse rotation of the drive motor 28*a* is count at S185. The procedure is then returned to S182. Thus, the sheet loosening operation which has been described in reference to FIG. 9(D) should be carried out.

Figure 31:
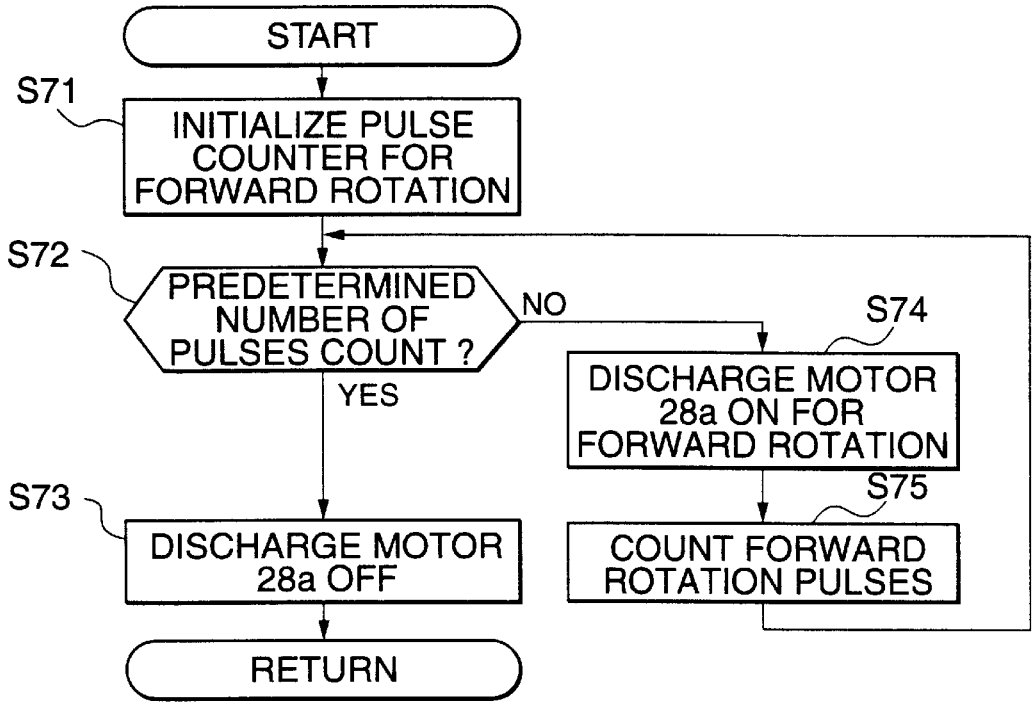
FIG. 31 is a flowchart of sheet loosening operation (S7) in FIG. 16.
Figure 32:
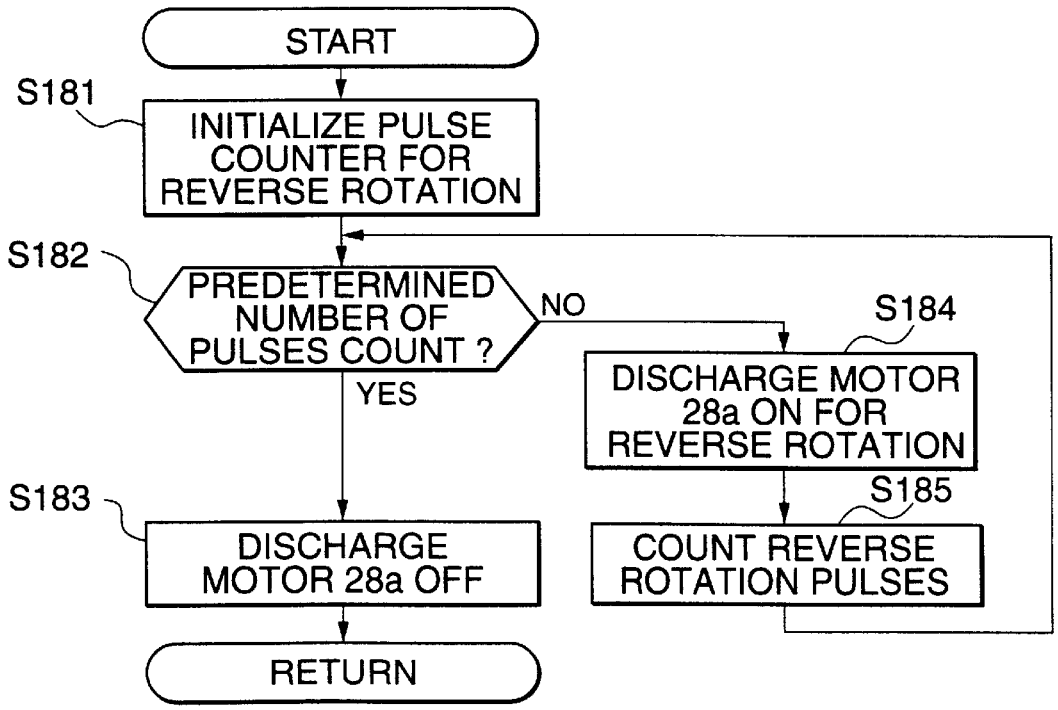
FIG. 32 is a flowchart of sheet loosening operation (S18) in FIG. 18.

The sheet discharging operation at S24 of the flowchart of FIGS. 16–18 is carried out as shown in the flowchart of FIG. 33. At first, it is discriminated if the Y-axis H/P sensor and the X-axis H/P sensor are ON or OFF at S241*a* and S241*b*, respectively. When the Y-axis H/P sensor is ON (YES at S241*a*), the Y-axis drive motor for driving the table 21 along the Y-axis is turned off at S242*a*. Likewise, when the X-axis H/P sensor is ON (YES at S241*b*), the X-axis drive motor for the table 21 is turned off at S242*b*. When the Y-axis H/P sensor is still OFF (NO at S241*a*), the Y-axis drive motor is driven in a reverse direction at S243*a*, and the procedure is returned to S241*a*. When the X-axis H/P sensor is still OFF (NO at S241*b*), the X-axis drive motor is driven in a forward direction at S243*b*, and the procedure is returned to S241*b*. The pulse counter is then initialized so that the amount of movement of the table 21 along the Y-axis is set to zero at S244. It is discriminated at S245 if the table 21 has been moved to predetermined Y-axis position. If this is confirmed (YES at S245), the Y-axis drive motor is turned off at S246. If not (NO at S245), the Y-axis drive motor is driven in a forward direction at S247, and the amount of forward movement of the table 21 is count at S248. The procedure is then returned to S245. After the Y-axis drive motor is turned off at S246, the sheet loosening operation by forward rotation of the discharge rollers 28 is carried out at S249 in the same manner as having been described in reference to the flowchart of FIG. 31, is carried out at S249, followed by initialization of the tensioning rollers 23 at S250 in the same manner as having been described in reference to the flowchart of FIGS. 21–22. Then, the amount of rotation of the discharge rollers 28 is initialized at S251, and it is discriminated at S252 if it reaches a predetermined amount. If so (YES at S252), the drive motor 28a for rotating the discharge rollers 28 is turned off at S253, and the procedure is returned to the flowchart of FIGS. 16–18. If not (NO at S252), the drive motor 28*a* is driven in a forward direction at S254, the amount of discharge movement of the base 11 is count at S255, and the procedure is returned to S252.

The pitch of natural hair on the human head is less than 1 mm, usually approximately 0.5 mm. Therefore, it is desirable that a wig has an equivalent hair transplanting pitch (P) of the order of 0.5 mm. In order to provide a hair transplanting pitch (P) of 0.5 mm in a wig, the needle with (W) should be much shorter than 0.5 mm, otherwise holes in the base 11 produced by needle penetration would become a continuous fissure. However, according to the present needle manufacturing technology, it is very difficult to provide a needle width (W) of less than 0.5 mm. Most of the conventional needle have the needle width (W) of greater than 1 mm. If the needle width (W) should be reduced to about 0.5 mm, the needle is easy to break when penetrating a wig base.

In accordance with the illustrated embodiment of the present invention, the hair transplanting pitch (P) is 2 mm and the width (W) of the needle 41 in a direction perpendicular to conveyance of the artificial hair 30 is 1 mm. The needle 41 penetrates the wig base 11 of woven fabric or cloth which is stretched by the tensioning rollers 23. After a predetermined number of the artificial hairs 30 has been transplanted on the base 11, the base 11 is released from the tensioning rollers 23, resulting in shrinkage of the base 11 so that the actual hair transplanting pitch is greatly reduced to approximately 0.5 mm, for example. This enables mechanization and automation of wig manufacturing operation. The base 11 of woven fabric provides good breathability, so that a human head would not get sweaty in a wig.

The artificial hair 30 once transplanted on the base 11 is absorbed by the static electricity generator 52 and blown away by the air flow from the fan 51, so that it is substantially oriented in a direction opposite to the needle movement. This prevents the adjacent hairs being twined around one another and facilitates hair transplanting operation.

The artificial hair 30 may be of any desired length. In practice, each bobbin 31 carries a continuous strip of the artificial hair 30 in an amount larger than the estimated amount of consumption in daily wig manufacturing.

The artificial hair 30 to be transplanted on the base 11 has any desired color by combination of the artificial hair of different colors, each being reeled around the bobbins 31A–31D. For example, a wig streaked with grizzled hair may easily be manufactured. An all-weather wig which is well resistant to water and moisture may also be manufactured by selecting material of the artificial hair 30.

Movement of the table 21 and the needle 41 is controlled by the control unit such as a computer. Although the artificial hair 30 is transplanted on the base 11 in a straight stitching manner in the illustrated embodiment, a zigzag transplanting path may also be applicable. The artificial hairs which have been once transplanted in a zigzag path would be more difficult to separate from the wig base than those manufactured by linear transplantation. A transplanting path may extend obliquely with respect to the X and Y axes.

In the illustrated embodiment of the wig manufacturing system of the present invention, the hair transplanting station A, the first adhesive applying station B, the cutting station C, the forming station D and the second adhesive applying station E are arranged in alignment. Accordingly, a wig may be manufactured through nonstop operation. In a modified embodiment, the forming station D may be omitted from the manufacturing line, in which case the system turns out two-dimensional wigs. The two-dimensional wig is formed into a three-dimensional configuration that is fittable to the user's head, when so ordered. The base 11 used in this invention is very thin and therefore easy to be formed into a desired shape at any time.

The present invention has been described in conjunction with a limited number of embodiments thereof, it is to be understood that many variations and modifications may be made without departing from the sprits and scope of the invention as defined in the appended claims. For example, a degree of tension to be applied to the base 11 may be adjusted depending upon a degree of material shrinkability of the base 11. The hair transplanting pitch (P) will also vary depending material shrinkability of the base 11. The base 11 is a fabric or cloth woven by fibers which preferably comprise resin fibers but may be any other fibers such as vegitable fiber and mineral fiber.

The length of the artificial hair 30 may be designed by the computer. Means for feeding the artificial hair 30 into the conduit 35 may be any suitable means other than the vacuum generator.

Figure 15A:
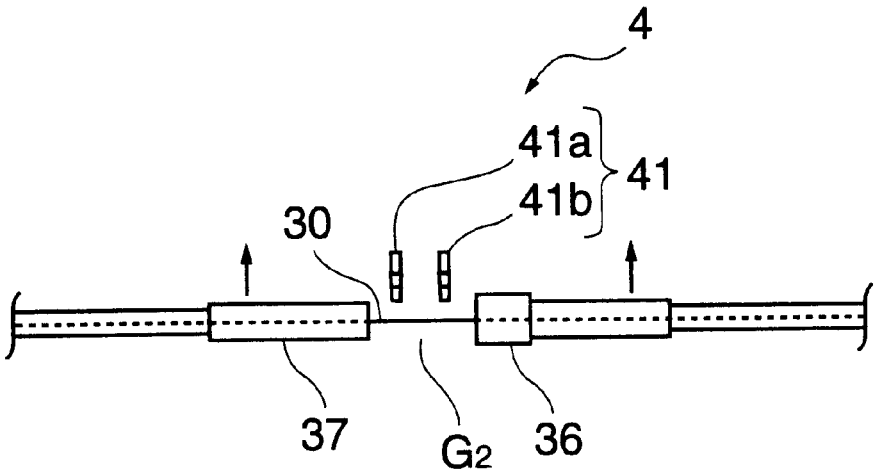
FIGS. 15(A)–(B) are plan views showing another embodiment of the hair transplanting station.
Figure 15B:
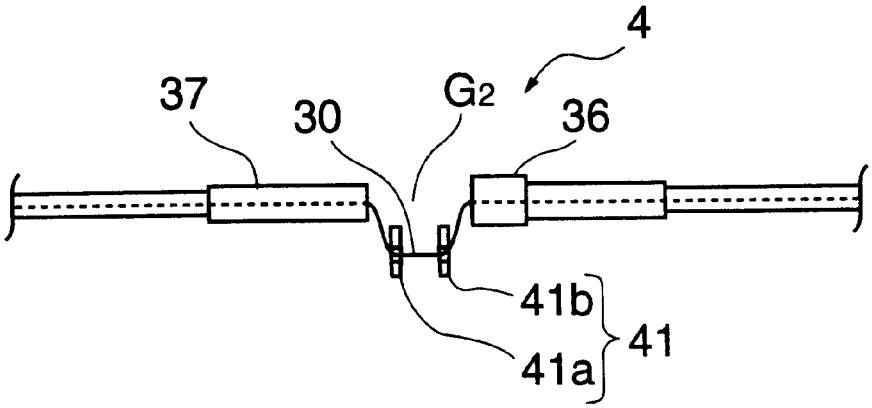

As shown in FIG. 15(A), the guides 36, 37 may be movable toward the needle 41. In this modification, these guides 36, 37 are moved in a direction shown by arrows, after the needle 41 has descended to the lowermost position, so that the intermediate portion of the artificial hair 30 is hooked by the needle 41, as shown in FIG. 15(B). This modification does not require the blocks 47 and 48.

A single artificial hair 30 may be fed to the table 21 for transplantation on the base 11. A predetermined number of artificial hairs 30 may also be fed to the table 21.

Since the present invention utilizes a very thin base 11, the wig manufactured thereby has wide application. The present invention is also applicable to manufacturing hairpieces and toupees. Any wigs for actors or actresses may also be manufactured by the present invention, which is adhered to a separate, relatively thick base formed into a three-dimensional configuration that fits on a wearer's head.

The needle 41 should reciprocate in directions perpendicular to the direction of movement of the artificial hair 30, but may be movable in any lateral direction.

What is claimed is:

1. An automated wig manufacturing apparatus comprising:

a conveyor table;

table drive means for moving said table on a two-dimensional plane at a predetermined pitch;

base supply means for supplying a two-dimensional thin base to said table;

tensioning and positioning means for stretching said base and positioning said stretched base at predetermined position with respect to said table;

artificial hair supply means for supplying an artificial hair to the underside of said stretched base;

hair transplanting means for transplanting said artificial hair on said base, said hair transplanting means including needle means reciprocating in first and second directions both perpendicular to said base, said needle means being moved in said first direction to penetrate said base and in said second direction, opposite to said first direction, to engage said artificial hair at the underside of said base so that said artificial hair carried by said needle means is transplanted on said base, hair transplanting operation by said hair transplanting means being repeated as said table is moved by said drive means to an adjacent position remote from a preceding position by said predetermined pitch;

said tensioning and positioning means being made inoperative after said hair transplanting operation by said hair transplanting means is completed, thereby releasing said base from being stretched by said tensioning and positioning means to allow shrinkage of said base due to material shrinkability thereof.

2. An apparatus according to claim 1 which further comprises:

first adhesive applying means for applying first adhesive to the underside of said base for adhering said transplanted artificial hair to said base;

cutting means for cutting said base, to which said first adhesive has been applied by said first adhesive applying means, into a base piece of a predetermined size;

forming means for forming said base piece into a predetermined three-dimensional configuration; and second adhesive applying means for applying second adhesive to the underside of said three-dimensional base.

3. An apparatus according to claim 1 wherein said base is woven fabric.

4. An apparatus according to claim 1 wherein said needle means has a needle groove extending perpendicular to a direction of supply of said artificial hair by said artificial hair supply means, said needle groove being adapted to engage said artificial hair when said needle means is moved in said second direction.

5. An apparatus according to claim 1 wherein said needle means comprises at least one pair of needles reciprocating in synchronism with each other, said needles being spaced by a predetermined distance in parallel with the direction of supply of said artificial hair by said artificial hair supply means.

6. An apparatus according to claim 1 wherein said pitch of movement of said table, which is a hair transplanting pitch in the hair transplanting operation by said hair transplanting means, is greater than width of said needle means perpendicular to the direction of supply of said artificial hair by said artificial hair supply means.

7. An apparatus according to claim 1 wherein said table is moved intermittently by said table drive means in a direction perpendicular to the direction of supply of said artificial hair by said artificial hair supply means, during the hair transplanting operation by said hair transplanting means.

8. An apparatus according to claim 1 wherein said table is moved intermittently by said table drive means in parallel with the direction of supply of said artificial hair by said artificial hair supply means, during the hair transplanting operation by said hair transplanting means.

9. An apparatus according to claim 1 wherein said hair transplanting means transplants said artificial hair on said base in a direction oblique to a direction of movement of said table by said table drive means.

10. An apparatus according to claim 1 which further comprises a computer for controlling movement of said table and said needle means.

11. An apparatus according to claim 1 wherein wherein said artificial hair supply means comprises a plurality of artificial hair supplying units, each supplying an artificial hair of a different color.

12. An apparatus according to claim 1 which further comprises hair separating means for disengaging said artificial hair from said needle means, after said artificial hair has been transplanted on said base by said hair transplanting means.

13. An apparatus according to claim 12 wherein said hair separating means comprises means for blowing an air flow to said transplanted artificial hair.

14. An apparatus according to claim 12 wherein said hair separating means comprises means for absorbing said transplanted artificial hair by vacuum suction.

15. An apparatus according to claim 12 wherein said hair separating means comprises a static electricity generator for absorbing said transplanted artificial hair by static electricity.

16. An apparatus according to claim 1 wherein said artificial hair supply means comprises a plurality of bobbins each carrying a continuous artificial hair of a different color, a plurality of first vacuum generators each being mounted adjacent to one of said bobbins to unreel said artificial hair therefrom, cutter means for cutting said unreeled artificial hair to a predetermined length, and a single second vacuum generator for conveying a mixture of said cut segments of said artificial hairs of different colors to the underside of said stretched base.

17. An apparatus according to claim 2 wherein said first adhesive applying means, said cutting means, said forming means and said second adhesive applying means are arranged in series in alignment with conveyance of said base.

18. An automated wig manufacturing process comprising the steps of:

supplying a two-dimensional thin base to a conveyor table;

stretching said base on said conveyor table;

positioning said stretched base with respect to said conveyor table;

supplying an artificial hair to the underside of said stretched base;

engaging said supplied artificial hair by reciprocating needle means which penetrates said stretched base, said needle means carrying said artificial hair being moved to above said base so that said artificial hair is transplanted on said stretched base;

repeating hair transplanting operation by said needle means while moving said conveyor table at a predetermined pitch; and releasing said base from being stretched, after the hair transplanting operation by said needle means is completed.

19. A process according to claim 18 which further comprises the steps of:

applying first adhesive to the underside of said base for adhering said transplanted artificial hair to said base;

cutting said base, to which said first adhesive has been applied by said first adhesive applying means, into a base piece of a predetermined size;

forming said base piece into a predetermined three-dimensional configuration; and applying second adhesive to the underside of said three-dimensional base.

* * * * *